United States Patent [19]

Peters

[11] Patent Number: 4,797,822

[45] Date of Patent: Jan. 10, 1989

[54] APPARATUS AND METHOD FOR DETERMINING THE POSITION OF A TOOL IN A BOREHOLE

[75] Inventor: Rex B. Peters, Woodinville, Wash.

[73] Assignee: Sundstrand Data Control, Inc., Redmond, Wash.

[21] Appl. No.: 948,323

[22] Filed: Dec. 31, 1986

[51] Int. Cl.[4] ..... G01V 3/18; E21B 47/00

[52] U.S. Cl. ..... 364/422; 73/151; 33/304

[58] Field of Search ..... 364/422; 33/304, 313; 73/151, 152

[56] References Cited

U.S. PATENT DOCUMENTS

| | | | |
|---|---|---|---|
| 4,362,054 | 12/1982 | Ringot | 73/152 |
| 4,542,647 | 9/1985 | Molnav | 33/304 X |
| 4,545,242 | 10/1985 | Chan | 73/152 |
| 4,662,209 | 5/1987 | Brown | 73/151 X |

*Primary Examiner*—Jerry Smith

*Assistant Examiner*—Steven G. Kibby

*Attorney, Agent, or Firm*—Christensen, O'Connor, Johnson & Kindness

[57] ABSTRACT

A system and method for precisely and continuously estimating the path length between the entrance of a borehole and a probe (10) which is supported by an elastic cable (14) and carries a gyrocluster (42) and accelerometer cluster (40). The precise estimate of borehole path length is used to aid the inertial navigation performed within the survey system and is selectively determined by integration of either the rate at which the probe (10) moves along the borehole or a compensated cable feed rate that is based on the rate at which the cable (14) passes into or out of the borehole with correction being made for changes in temperature and gravity induced cable stretch. Selection of the rate to be integrated at any given time being determined by whether the rate at which probe (10) moves along the borehole exceeds the compensated cable feed rate by a predetermined amount.

32 Claims, 5 Drawing Sheets

APPARATUS AND METHOD FOR DETERMINING THE POSITION OF A TOOL IN A BOREHOLE

TECHNICAL FIELD

This invention relates to methods and apparatus for precisely and continuously determining the length of an elastic support cable that is under tension. The invention particularly relates to determining the true position of a tool or device that is raised and lowered through a borehole such as an oil or gas well by means of an elastic cable.

BACKGROUND OF THE INVENTION

Borehole survey systems used for geological surveying, mining and the drilling of oil and gas wells generally map or plot the path of a borehole by determining borehole azimuth (directional heading relative to a reference coordinate such as north) and borehole inclination (relative to vertical) at various points along the borehole. For example, in one early type of prior art system, a tool or probe that contains one or more magnetic or gyroscopic compasses for indicating azimuth and one or more pendulums or accelerometers for indicating inclination is suspended by a cable and raised and lowered through the borehole. In such a system, the position of the probe along the borehole is determined by the length of cable that extends between the entrance of the borehole (wellhead) and the probe and the position information is combined with the azimuth and inclination information to provide a plot or map of the borehole relative to a desired coordinate system (e.g., a Cartesian coordinate system centered at the wellhead with the Z-axis extending downwardly toward the center of the earth and the X and Y axes extending in the direction of true north and true east, respectively). This early type of prior art system is subject to several disadvantages and drawbacks, including inaccuracies of the devices utilized to indicate azimuth and inclination and, of particular relevance to the present invention, inability to precisely determine the length of the cable that supports the probe or tool.

Various considerations have brought about an ever increasing need for borehole surveying apparatus that is more precise and compact than the above discussed type of prior art arrangements. For example, modern gas and oil drilling techniques often require that wells be closely spaced and, in addition, it is not unusual for a number of wells to be drilled toward different geological targets from a single wellhead or drilling platform. Further, depletion of relatively large deposits has made it necessary to drill deeper and to access smaller target formations. Even further, in the event of a deep, high-pressure blowout, precise knowledge of the borehole path is required so that a relief well can be drilled to intercept the blowout well at a deep, high-pressure formation.

One proposal for providing a small diameter probe for a borehole survey system involves the application of inertial navigation techniques that previously have been employed to navigate aircraft, spacecraft and both surface and subsurface naval vessels. Generally, speaking, these inertial navigation techniques utilize an instrumentation package that includes a set of accelerometers for supplying signals that represent acceleration of the instrumentation package along the three axes of a Cartesian coordinate system and a set of gyroscopes for supplying signals representative of the angular rate at which the instrumentation package is rotating relative to that some Cartesian coordinate system. Two basic types of systems are possible: gimballed systems and strapdown systems. In gimballed systems, the gyroscopes and accelerometers are mounted on a fully gimballed platform which is maintained in a predetermined rotational orientation by gyro-controlled servo systems. In effect, this maintains the accelerometers in fixed relationship so that the accelerometers provide signals relative to a coordinate system that is substantially fixed in inertial space, e.g., a Cartesian coordinate system wherein the Z-axis extends through the center of the earth and the X and Y axes correspond to two compass directions. Successive integration of the acceleration signals twice with respect to time thus yields signals representing the velocity and position of the instrumentation package in inertial space (and, hence, the velocity and position of the aircraft, ship or probe of a borehole survey system).

In strapdown inertial navigation systems, the gyros and accelerometers are fixed to and rotate with the instrumentation package and hence with the aircraft, naval vessel or borehole survey probe. In such a system, the accelerometers provide signals representative of the instrument package acceleration along a Cartesian coordinate system that is fixed relative to the instrumentation package and the gyro outputs are processed to transform the measured accelerations into a coordinate system that is fixed relative to the earth. Once transformed into the desired coordinate system, the acceleration signals are integrated in the same manner as in a gimballed navigation system to provide velocity and position information.

Regardless of whether a borehole survey system is implemented with gimballed or strapdown techniques (or a hybrid configuration wherein the accelerometers are gimballed relative to one or more axes of rotation), currently available accelerometers and gyroscopes do not provide satisfactory positional accuracy, unless the system is compensated or "aided." For example, the positional accuracy of a borehole survey system utilizing currently available accelerometers and gyroscopes having an accuracy of one nautical mile per hour will drift between 1,500 and 3,000 feet during a 30-minute survey. Such an error is approximately two orders of magnitude greater than that necessary to precisely survey relatively deep boreholes.

Conceptually speaking, aiding an inertial navigation system to improve long-term stability involves comparing the position or velocity signals provided by the inertial navigation system with position or velocity or velocity signals that are obtained from another source to thereby provide error signals. Since the dynamics associated with the propagation of errors within an inertial navigation system are relatively well known, the error signals can be processed to continuously or periodically modify the signal processing performed by the navigation system. One technique that has been proposed for aiding borehole navigation systems is to periodically stop the probe. The velocities indicated by the system with the probe at rest are error signals that can be utilized to estimate the true state of the system and various error parameters associated with the inertial instruments.

Repeatedly stopping the probe during a survey is undesirable in that it substantially increases the time required for the survey operation and thus results in higher costs. Moreover, to provide a high degree of accuracy, the probe must be stopped frequently or, in the alternative, the data collected during periods of time in which the probe is moving must be analyzed after the survey is complete to at least partially eliminate navigation errors that occur between the periods of time in which the probe is brought to rest.

One technique for minimizing or eliminating the need to stop the probe involves comparing an inertially derived estimate of the borehole path length between the probe and borehole entrance opening with a path length signal that is based on measuring the cable fed into or withdrawn from the borehole representative of the length of the cable that supports the probe. Specifically, in a strapdown borehole navigation system in which the Z-axis of the probe reference coordinate system extends along the longitudinal centerline of the probe, integration of the Z-axis accelerometer signal twice with respect to time provides a calculated position signal that is theoretically equal to the distance that the probe has traveled along the borehole and, hence, ideally is equal to the distance between the wellhead and the probe (as measured along the path of the borehole). If the actual length of the cable that supports the probe (i.e., extends between the wellhead and the probe) were known, it then would be possible to combine the inertially derived position signal with a signal representing the actual cable length to obtain an error or difference signal that can be utilized for precise aiding of the inertial navigation system.

The simplest approach to obtaining such a cable length signal is to measure the cable as it passes into or out of the borehole. At least two primary problems are encountered in applying this technique. Firstly, a signal must be generated that continuously and accurately represents the length of cable that is payed out or reeled in. Secondly, the technique must account for changes in cable that result because of stretching of the cable, including changes in cable stretching that occur when the probe cannot move at the rate at which cable is payed out or reeled in (because frictional forces stop or slow the probe, or because of an excessive cable feed rate).

Various prior art proposals have greatly reduced the problem of accurately determining the length of cable that is payed out or reeled in. For example, relatively accurate results are obtained by systems wherein the cable is directed through a pulley of predetermined radius at or near the point at which the cable passes into the wellhead. In most such systems, an associated electronic circuit provides a pulse signal each time the pulley rotates through a predetermined arc. The number of signal pulses are counted to provide an indication of the amount of cable that has passed into or out of the borehole. In some such prior art systems, compensation is provided for environmental factors such as frozen mud or other foreign material that, in effect, changes the radius of the measurement pulley.

Prior art proposals for compensating the measured cable length for cable stretch have been less satisfactory than systems for indicating the length of cable that passes into and out of the wellhead. For example, in the cable stretch compensation technique disclosed in U.S. Pat. No. 3,490,150, a first force measurement is made at the wellhead (e.g., as the cable passes through the measuring pulley) and a second force measurement is made at the probe. The measured forces are then combined with an estimate of the elastic compliance of the cable to provide an estimate of the amount by which the cable is stretched. One drawback of such a system is that very accurate force measurement devices are required which cannot easily be incorporated in the system probe or in wellhead equipment. Another drawback is that such a system exhibits relatively poor dynamic accuracy. In this regard, cable strain and, hence, the cable stretch is a function of both the force exerted on the cable and the temperature of the surrounding environment. Since borehole temperature increases with borehole depth, a cable moving through the borehole is exposed to temperature gradients that affect cable length. Further, the mechanical strain exerted on each incremental section of the cable is a function of: (a) the weight of the probe and weight of the cable located below that incremental section (which are functions of the borehole path [inclination] as well as probe and cable mass); (b) the frictional forces that are exerted on the probe by the surrounding walls of the borehole; and, (c) the frictional forces that are exerted on each incremental section of the cable that is within the borehole. Since each of these parameters can vary along the course of a borehole, simply measuring the force exerted on the cable at the wellhead and at the probe cannot provide totally satisfactory compensation for cable stretch.

An arrangement that partially overcomes these prior problems of using cable measurement to determine probe position is disclosed in U.S. Pat. No. 4,545,242. In that arrangement, a Kalman Filter is utilized to estimate probe length and probe velocity based on cable measurement and probe acceleration. If the probe becomes stuck in the borehole the estimate of probe depth is maintained constant by altering the values of various parameters utilized in the Kalman filtering process. When the probe resumes movement, the altered parameters gradually are returned to normal as a function of the time duration during which the probe was stuck. Although this proposal appears to be an improvement over previous attempts to continuously and accurately measure probe depth, the arrangement is somewhat complex. Further, the arrangement may not provide accurate results during time intervals during which the probe resumes movement after being stuck or during time intervals during which the probe does not stick tightly, but is slowed because of, for example, a constriction within the borehole.

SUMMARY OF THE INVENTION

In accordance with this invention, the distance between a cable supported instrument package such as a probe and the entrance of a borehole through which the instrument package moves is determined by linear estimation of the physical process involved and by sequentially processing signals representative of probe and cable weight, temperature variation along the borehole and probe inclination as the instrument package is moved along the borehole (e.g., raised or lowered by means of the elastic cable).

In the practice of the invention, the rate at which cable is fed into or retrieved from the borehole (cable feed rate) is combined with a cable feed rate correction signal that compensates for gravity and temperature induced cable stretch. During periods of time in which the probe moves at or near the compensated cable feed rate, the compensated feed rate is integrated to determine the distance traveled by the probe along the borehole.

As the probe moves along the borehole, the compensated cable feed rate is continuously compared with an inertially derived probe velocity, which is obtained by integrating signals provided by one or more accelerometers that are mounted within the probe. When the magnitude of the difference between the inertially-derived probe velocity and the compensated cable feed rate exceeds a predetermined value, the inertially-derived velocity is integrated to determine the distance traveled along the borehole. This provides an accurate indication of probe position during those time periods in which the probe is stuck or slowed by constrictions or other conditions within the borehole and during periods of time in which the probe is accelerating or decelerating because of a change in cable tension.

In the currently preferred embodiments of the invention, the cable feed rate correction signal is determined by sequential signal processing that utilizes the estimated probe position, probe weight, cable weight, inclination of the probe from vertical and borehole temperature. To synchronize the cable feed rate with the signal processing sequence and to provide maximum accuracy, the currently preferred embodiments of the invention process the cable feed rate signal using prediction-correction techniques prior to combining the cable feed rate with the cable feed rate correction signal.

In the disclosed embodiment, the invention is employed in combination with a borehole survey or mapping system that utilizes strapdown inertial navigation techniques (or, alternatively, hybrid strapdown-gimballed system techniques). In this borehole survey system, the inertial navigation utilized provides a signal representative of probe velocity relative to a coordinate axis that coincides with the longitudinal centerline of the probe. The velocity signal is processed to provide a position signal that is mathematically equal to the integral of the velocity signal with respect to time and, absent drift and error measurement is precisely equal to the distance the probe has traveled along the borehole during any particular survey period. To provide an error signal for aiding the inertial navigation system, the precise estimate of cable length that is provided by the invention is used as an indication of borehole path length and is subtracted from the inertially determined position signal. The error signal is continuously processed to update the inertial navigation process so as to eliminate both component drift and measurement error.

In the currently preferred realizations of the disclosed embodiment, the sequential signal processing that supplies the precise estimate of cable length is effected either within the signal processor (e.g., programmed digital computer) that implements the inertial navigation process or is effected by a separate signal processor such as a microprocessor circuit that operates in conjunction with the inertial navigation signal processor. In these realizations, the sequential signal processing rate that supplies the precise estimate of cable length (and, hence, borehole path length) either is the same as or easily can be synchronized with the sequential signal processing that performs the inertial navigation computations. In these embodiments, pulses supplied by a calibrated pulley indicate the rate at which cable is fed into or withdrawn from the borehole. Since the cable feed rate is asynchronous relative to the sequential signal processing that is utilized in the inertial navigation computation and in generating the signal representing the cable stretch compensated precise estimate of probe location, the disclosed embodiment of the invention includes additional signal processing that provides cable feed velocity signals at the rate that is utilized in implementing the navigation computations and the precise estimate of cable length.

BRIEF DESCRIPTION OF THE DRAWINGS

The aforementioned advantages and features of the invention and others will be apparent to one skilled in the art upon reading the following description in conjunction with the accompanying drawings in which:

FIG. 2 is a block diagram that illustrates an arrangement for performing the inertial navigation signal processing for the borehole survey system of FIG. 1 and illustrates the interconnection of the invention with that arrangement;

DETAILED DESCRIPTION

Figure 1:
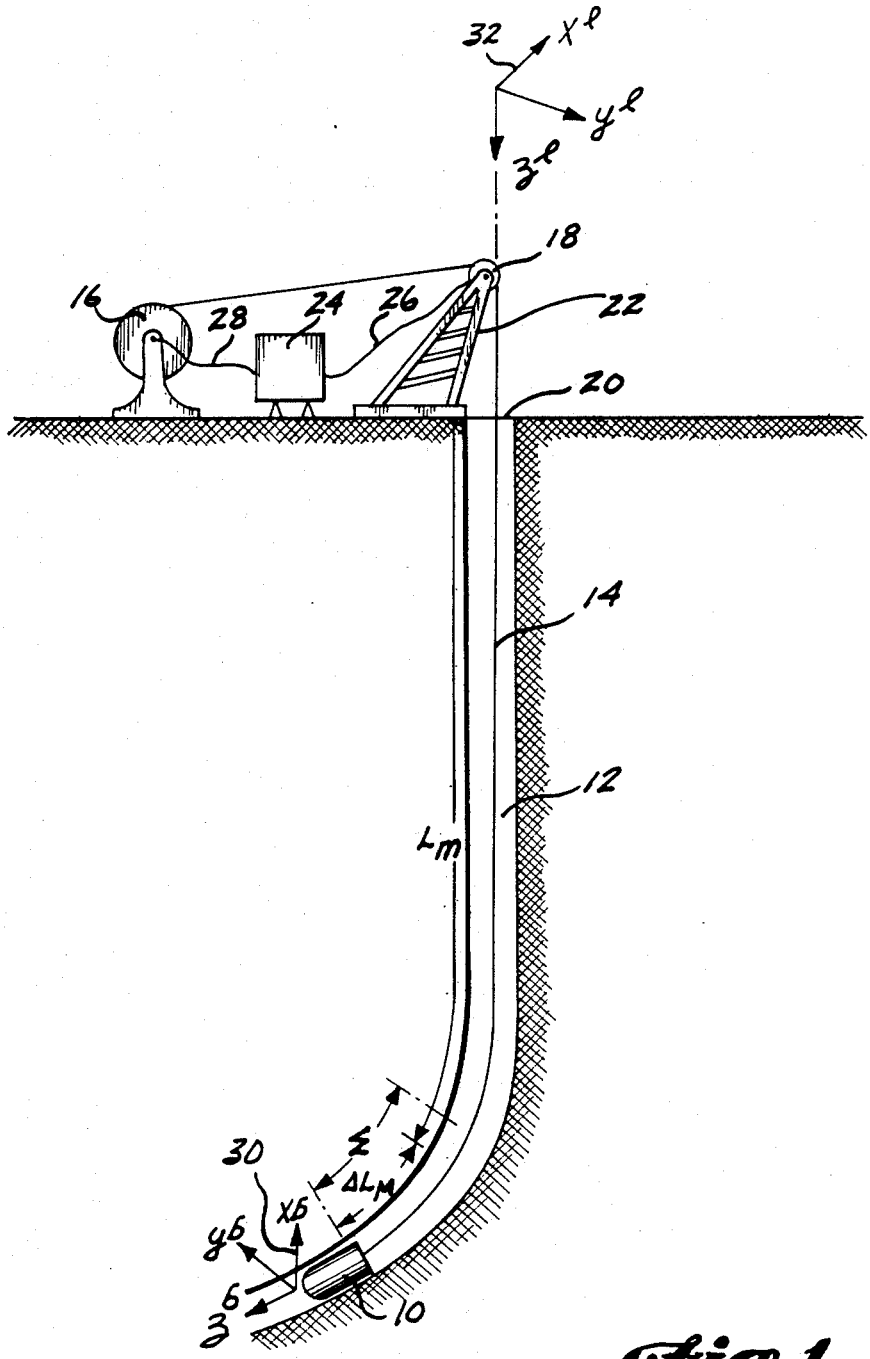
FIG. 1 schematically illustrates a borehole survey system of a type that can advantageously employ the invention.

FIG. 1 schematically illustrates a representative environment for the currently preferred embodiment of the invention and provides an understanding of the various parameters and variables that are utilized in the practice of the invention. In FIG. 1, a borehole survey probe 10 of an inertial borehole survey system is supported in a borehole 12 by means of an elastic cable 14 of conventional construction (e.g., a multistrand flexible steel cable having a core that consists of one or more electrical conductors). The upper end of cable 14 is connected to a rotatable drum of a cable reel 16 that is positioned near borehole 12 and is utilized to raise and lower probe 10 during a borehole survey operation.

Cable 14 that is payed out or retrieved by cable reel 16 passes over an idler pulley 18 that is supported above wellhead 20 of borehole 12 by a conventionally configured cable measurement apparatus 22. Idler pulley 18 is of known radius and electrical circuitry is provided (not shown) for supplying an electrical pulse each time idler pulley 18 is rotated through a predetermined arc. Thus, each signal pulse provided by cable measurement apparatus 22 indicates that an incremental length of cable $\Delta l_c = r\Delta\phi$ has passed over idler pulley 18 where r is the radius of idler pulley 18 and $\Delta\phi$ represents the amount of angular rotation of idler pulley 18 required to produce a signal pulse (in radians).

As is indicated in FIG. 1, the signal pulses supplied by cable measurement apparatus 22 are coupled to a signal processor 24 via a signal cable 26. Signal processor 24, which is connected to cable reel 16 by a signal cable 28, transmits control signals to and receives information signals from probe 10 (via the electrical conductors of cable 14 and signal cable 28). In addition, signal processor 24 sequentially processes the signals supplied by probe 10 and cable measurement apparatus 22 to accurately determine the position of probe 10. As is known in the art, signals can be transmitted between signal processor 24 and probe 10 by other means such as pressure impulses that are transmitted through the fluid or drilling mud that fills borehole 12 rather than by means of cable 14.

In strapdown inertial borehole survey systems probe 10 includes an accelerometer cluster (not depicted in FIG. 1) that provides signals representative of probe acceleration along the axes of a Cartesian coordinate system that is fixed relative to probe 10 and includes a gyroscope cluster (not depicted in FIG. 1) that provides signals representative of the angular rotation of probe 10 about the same coordinate axes. In FIG. 1, the strapdown coordinate system for probe 10 is indicated by the numeral 30 and consists of a right-hand Cartesian coordinate system wherein the z axis ($z^b$) is directed along the longitudinal centerline of probe 10 and the x and y axes ($x^b$ and $y^b$) lie in a plane that is orthogonal to the longitudinal centerline of probe 10. The coordinate system 30 that is associated with probe 10 is commonly called the "probe body" or "body" coordinate system and signal and signal processor 18 processes the probe body coordinate acceleration and angular rate signals provided by the accelerometer and gyroscope clusters of probe 10 to transform the signals into positional coordinates in a coordinate system that is fixed relative to the earth. The coordinate system that is fixed relative to the earth is commonly called the "earth" or "local level" coordinate system and is indicated in FIG. 1 by the numeral 32. In level coordinate system 32 of FIG. 1, the $z^l$ axis extends downwardly and passes through the center of the earth and the $x^l$ and $y^l$ axes correspond to two orthogonal compass directions (e.g., north and east, respectively).

As also is known, the probe body coordinate acceleration and velocity signals can be transmitted directly to signal processor 24 via the conductors within cable 14 (or other conventional transmission media) or can be accumulated within a memory unit (not shown in FIG. 1) that is located within probe 10 and either transmitted to signal processor 24 as a series of information frames or retrieved for processing when probe 10 is withdrawn from borehole 12. In addition, if desired, probe 10 can include a microprocessor circuit for effecting at least a portion of the signal processing that is otherwise performed by signal processor 24. In any case, sequentially processing the signals supplied by the accelerometer and gyroscope clusters of probe 10 provides $x^l$, $y^l$, $z^l$ coordinate values for the position that probe 10 occupies in borehole 12. When probe 10 is moved along the entire length of borehole 12 by means of cable 14, the coordinate values thus obtained collectively provide a three-dimensional map or plot of the path of borehole 12.

FIG. 2 illustrates one type of arrangement for performing the inertial navigation signal processing required in the strapdown borehole navigation system of FIG. 1 and also generally illustrates the interconnection of the invention with that arrangement for performing inertial navigation signal processing. Specifically, FIG. 2 generally depicts a borehole navigation system of the type disclosed in the U.S. patent application No. 948058 of Rand H. Hulsing, II, entitled "Borehole Survey System Utilizing Strapdown Inertial Navigation," which was filed of even date with this application and is assigned to the same assignee. As shall be recognized upon understanding the invention and the borehole navigation system of FIG. 2, the invention can be utilized in numerous other situations, including various situations that require an accurate measurement of the distance between a cable-supported tool and the entrance opening of a borehole.

In FIG. 2, the inertial navigation portion of the required signal processing (performed, for example, by signal processor 24 of FIG. 1) is illustrated within a dashed outline that is identified as inertial navigation computer 36. The signal processing performed in accordance with the invention to provide an aiding signal for the depicted borehole navigation system is identified in FIG. 2 as probe position computer 38. Upon understanding the signal processing that is effected in accordance with the invention, it will be recognized that the invention (e.g., probe position computer 38 of FIG. 2) provides a signal that accurately represents the distance (path length) between tool 10 and wellhead 20 of FIG. 1. It will further be recognized that the signal processing performed in accordance with the invention either can be implemented by a separate signal processor (e.g., probe position computer 38 of FIG. 2) or can be implemented in conjunction with signal processing of the system employing the invention (e.g., within signal processor 24 of FIG. 1).

As is shown in FIG. 2, signals are coupled to inertial navigation computer 36 by an accelerometer cluster 40, a gyrocluster 42 and a temperature sensor 44, each of which is located within probe 10. The signals provided by temperature sensor 44 are utilized within inertial navigation computer 36 (and/or within probe 10) to effect compensation for temperature dependencies of the signals provided by accelerometer cluster 40 and gyrocluster 42. As shall be discussed hereinafter, in the currently preferred embodiment of the invention, the temperature representative signal provided by temperature sensor 44 is utilized to compensate for temperature induced stretching of cable 14 and, hence, is shown in FIG. 2 as being coupled to probe position computer 38.

The probe body coordinate acceleration signals supplied by accelerometer cluster 40 are coupled to block 48 of inertial navigation computer 36. The probe body coordinate acceleration signals are processed at block 48 to transform the acceleration signals from the body coordinate system (coordinate system 30 of FIG. 1) to the level coordinate system (level coordinate system 32 of FIG. 1). As is indicated in FIG. 2, the signal processing involved in transforming the body coordinate acceleration signals to the level coordinate system corresponds to multiplying each set of body coordinate acceleration signals (x, y and z components) by a probe body to level coordinate transformation matrix, $C_b^L$.

As is indicated by navigation correction block 50 of FIG. 2, the level coordinate acceleration signals which result from the coordinate transformation performed at block 48 are corrected for a Coriolis effect, centrifugal acceleration of probe 10, and the variation in gravitational force on probe 10 with respect to depth. The corrected level coordinate probe acceleration signals that result from the navigation correction performed at block 50 are further corrected by subtraction of velocity error signals within a signal summer 52.

As is indicated by integrator 54 of FIG. 2, the resulting signals are then integrated to supply a set of level coordinate velocity signals $v^L$. The probe level coordinate velocity signals are then corrected by subtraction of a set of position error signals (in signal summer 56 in FIG. 2) and the resulting set of signals are supplied to an integrator 58, which produces the system output signals $P_x$, $P_y$, $P_z$ (which represent the position of probe 10 in the level coordinate system). As can be seen in FIG. 2, the $P_z$ signal is coupled to probe position computer 38 and, in addition, is fed back to navigation correction block 50 via gravity model 60. Gravity model 60 supplies signals to navigation correction block 50 which correct the probe acceleration level coordinate signals for changes in gravitational force that occur as a function of probe depth. Various gravity models can be utilized, including the gravity model disclosed in the U.S. patent application of Rex B. Peters, entitled "Apparatus and Method for Gravity Correction in Borehole Survey Systems," Ser. No. 948,100, filed Dec. 31, 1986 and assigned to the assignee of this invention.

As also is shown in FIG. 2, in the depicted inertial navigation computer 36, the probe level coordinate velocity signals also are supplied to a transport rates block 62 and a transformation block 64. The signal processing performed at transport rates block 62 compensates the probe acceleration signals for centrifugal acceleration and provides an input signal to navigation correction block 50 and C matrix update block 66. As previously mentioned, navigation correction block 50 represents the signal processing that corrects the probe acceleration level coordinate signals for various factors such as Coriolis effect. The signal processing represented by C matrix update block 66 provides new coefficient values for the $C_b^L$ matrix described relative to transformation block 48 with each iteration of the signal processing sequence. As is indicated in FIG. 2, a signal summer 68 provides an additional input signal to C matrix update block 66 which is equal to the difference between the rate signals supplied by gyrocluster 42 of probe 10 and tilt error rate signals (X and Y level coordinates only).

The signal processing performed at transform block 64 transforms the probe velocity level coordinate signals supplied by signal summer 56 into the probe body coordinate system for signal processing that will result in the above-mentioned tilt error rate signals, velocity error signals and position error signals. As is indicated in block 64 of FIG. 2, this transformation corresponds to multiplication of the probe level coordinate velocity signals (in matrix form) by the mathematical transpose ($C^T$) of the probe body to level coordinate transform matrix ($C_b^L$), which was discussed with respect to transform block 48. The probe body coordinate velocity signals that result from the transformation effected at block 64 are supplied to an integrator 70, with the Z-axis component thereof ($v_z^b$) also being supplied to probe position computer 38.

The signal processing that generates the navigation system tilt error rate signals, velocity error signals and position error signals is indicated at block 72 of FIG. 2 and consists of transformation of the probe body coordinate position signals into the level coordinate system. As is indicated at block 72, the transformation mathematically corresponds to matrix multiplication of the probe position signals (in the probe body coordinate system) by the previously discussed transformation matrix $C_b^L$. In the currently preferred embodiments of the invention, the elements of this transformation matrix and the above-discussed signal processing are established on the basis of an error model which implements a minimum variance estimate of the system state by means of Kalman filtering techniques. Such implementation is known in the art and is discussed, for example, in U.S. Pat. No. 4,542,647. With respect to the arrangement of FIG. 2, it is important to note that the probe body X and Y level coordinate position signals are directly transformed (i.e., supplied to transformation block 72 of FIG. 2 by integrator 70), whereas the probe body Z coordinate position is processed to provide a position error signal $\Delta P_z$, which is supplied to transformation block 72. More specifically, probe position computer 38 supplies a signal $l_c$, which is a precise estimate of the path length of that portion of borehole 12 that extends between wellhead 20 and probe 10. This precise path length estimate is subtracted from the inertially derived body coordinate position signal $P_z^b$ (in signal summer 74) to produce the position error signal $\Delta P_z$.

In the arrangement of FIG. 2, the signals that result from the signal transformation indicated at block 72 are processed to: (a) provide the position error signals to signal summer 56 by multiplying the X, Y and Z level coordinate position error values by suitable coefficients $K_{1x}$, $K_{1y}$ and, $K_{1z}$ (indicated at block 76); (b) provide the velocity error signals to signal summer 52 by multiplying the level coordinate position error values by suitable coefficients $K_{2x}$, $K_{2y}$ and, $K_{2z}$ (indicated at block 78); and, (c) provide the tilt error rate signals to signal summer 68 by multiplying the X and Y components of the level coordinate position error signals by suitable coefficients $K_{3x}$, and $K_{3y}$ (indicated at block 80 of FIG. 2).

In addition, the x and y component of the signals provided by transformation block 72 are: multiplied by suitable coefficients, $K_{4x}$ and $K_{4y}$ (at block 73); integrated (at block 75); and supplied to earth rates block 77. Earth rates block 77 supplies a signal to navigation corrections block 50 and C matrix update block 66 to provide correction for Coriolis effect. Generally, such correction is quite small in a system of the type depicted in FIGS. 1 and 2. Thus, $K_{4x}$ and $K_{4y}$ are relatively small and may be equal to zero.

The signal processing utilized in accordance with the invention to supply the precise cable length estimate $l_c$ for aiding the navigation computations of an inertial borehole survey system (e.g., inertial navigation computer 36 of FIG. 2) can be understood by considering a mathematical model of the cable support system depicted in FIG. 1. In this regard, the distance between wellhead 20 and probe 10 can be expressed as $L=L_m+\Delta L_m$, where $L_m$ represents the amount of cable measured by cable measurement apparatus 22 as probe 10 is lowered from wellhead 20 to any position within borehole 12 and $\Delta L_m$ represents the difference between $L_m$ and the true position of probe 10 (i.e., the amount of stretch in cable 14). Under these conditions, the cable stretch $\Delta L_m$ can be expressed as:

$$\Delta L_m = \int_0^{L_m} \epsilon(\Sigma)d\Sigma - \int_0^{L_m} \epsilon_0(l)dl \qquad (1)$$

where: l represents cable length fed into borehole 12 (measured from wellhead 20): $\Sigma$ represents distance along cable 14 measured from probe 10; $\epsilon(\Sigma)$ represents the strain on cable 14 expressed as a function of the distance variable $\Sigma$ when cable measurement apparatus 22 indicates that the cable length l is equal to $L_m$; and, $\epsilon_0(l)$ represents the strain on an incremental length of cable 14 that is located at wellhead 20 as a function of the length of cable that extends downwardly into borehole 12.

It can be noted that the two components of the analytical expression set forth at Equation (1) are integrals in two different domains. That is, the first integral corresponds to a strain integration over the entire length of cable 14 that extends between wellhead 20 and probe 10 at the instant in time when the cable length, l, is equal to $L_m$. The second integral of equation (1) in effect is an integral over time, since it corresponds to the accumulated effect for each incremental length of cable (dl) that passes over idler pulley 18 during the period of time that elapses while probe 10 is moved to a position in borehole 12 that corresponds to distance $L_m$.

The difference between the two integrals represents the cumulative effect of changes in the state of each increment of cable between the time it is measured and the time it arrives at a position down the borehole. If the two strain conditions are the same, as they would be, for example, in an ideal borehole with constant slope, temperature, and friction, then the two integrals are the same and there is no error. This result agrees with intuition.

The strain exerted on each incremental length of cable 14 (both $\epsilon_0(l)$ and $\epsilon(\Sigma)$) can be represented by a linear model of the form:

$\epsilon = E \cdot F + \alpha \cdot K$ where E represents the elastic compliance of cable 14 (expressed, for example, in parts per million/Newton); F represents the force on the incremental length of cable 14; $\alpha$ represents the temperature coefficient of cable 14 (expressed, for example, in parts per million/°K.); and, K represents the temperature of the incremental length of cable 14. Incorporating this linear model in Equation (1) yields:

$$\Delta L_m = \tag{2}$$

$$E \int_0^{L_m} \left\{ w_p \operatorname{Cos} I + F_p + \int_0^{\Sigma} (w_c \operatorname{Cos} I + f_c) d\sigma \right\} d\Sigma - E \int_0^{L_m} \left\{ w_p \operatorname{Cos} I + F_p + \int_0^{l} (w_c \operatorname{Cos} I + f_c) d\sigma \right\} dl + \alpha \int_0^{L_m} \Delta\theta_c(\Sigma) d\Sigma$$

where $w_p$ represents the weight of probe 10 (corrected for buoyancy relative to any drilling mud or fluid contained in borehole 12); $F_p$ represents the frictional force exerted on probe 10 by borehole 12 and/or drilling mud or liquid within borehole 12; $w_c d\sigma$ represents the weight of each incremental length of cable 14 (corrected for buoyancy); $f_c d\sigma$ represents the friction asserted on each incremental length of cable 14 by borehole 12 and/or any drilling mud or fluid within borehole 12; $\Delta_{\theta c}$ represents the temperature difference between the temperature at wellhead 26 and each incremental length of cable 14 (as a function of the distance variable $\Sigma$); and I represents borehole inclination (measured relative to the Z-axis of level coordinate system 32 FIG. 1).

In examining Equation (2), it can be noted that $w_p$ (buoyancy corrected probe weight) and $w_c$ (buoyancy corrected cable weight per unit length) are well defined for each particular borehole survey situation. Moreover, probe 10 produces signals representative of borehole inclination, I, during the borehole survey. For example, those familiar with the type of inertial borehole survey system described herein, will recognize that I can be obtained from the $C_b^L$ matrix discussed relative to transformation blocks 48 and 72 of FIG. 2 since the transformation matrix includes elements representing the direction cosine coordinates of probe 10 (relative to the level coordinate system) for the then current position of probe 10 in borehole 12.

Neither the temperature distribution along the portion of cable 14 that passes through borehole 12 (i.e., $\Delta_{\theta c}(\Sigma)$), nor the frictional forces $F_p$ and $f_c$ that act on probe 10 and cable 14 are readily available during the operation of an inertial borehole survey system. Thus, without additional approximation or modeling of the temperature profile along cable 14 and accounting for frictional forces, Equation (2) cannot provide a precise estimate of cable stretch and, hence, Equation (2) cannot be utilized to directly obtain the desired path length estimate. In accordance with this invention, the need for approximating the friction forces included in Equation (2) is eliminated and signals representative of the probe temperature (e.g., supplied by temperature sensor 44 of FIG. 1) are utilized to approximate the temperature profile along cable 14.

The approximation utilized by the invention for the temperature profile of cable 14 is:

$$\Delta\theta_c(\Sigma) d\Sigma \simeq \Delta\theta_p(l) dl \tag{3}$$

where $\Delta\theta_p$ (l)dl corresponds to the temperature change measured by temperature sensor 44 of probe 10 as probe 10 is moved downwardly through an incremental distance dl. As will be recognized by those skilled in the art, this approximation corresponds to an assumption that the temperature of each particular incremental length of cable 14 that lies between probe 10 and wellhead 26 will be the same as the temperature measured by probe 10 at the time probe 10 passed by the location occupied by that particular incremental length of cable 14.

By substituting Equation (3) into Equation (2) and by representing the terms introduced by gravity and temperature as $\Delta l_s$ and the terms introduced by the frictional forces $F_p$ and $f_c$ as $\Delta l_f$ yields:

$$\Delta L_m = \Delta l_s + \Delta l_f, \text{ where} \tag{4}$$

$$\Delta l_s = E \left[ \int_0^{L_m} w_p \operatorname{Cos} I \, d\Sigma + \int_0^{L_m} \int_{\Sigma}^{0} w_c \operatorname{Cos} I \, d\sigma d\Sigma - \int_0^{L_m} w_p \operatorname{Cos} I \, dl - \int_0^{L_m} \int_0^{l} w_c \operatorname{Cos} I \, d\sigma dl \right] + \alpha \int_0^{L_m} \Delta\theta_p dl$$

As shall be described in the following paragraphs, the invention provides an accurate estimate of the path length component $\Delta l_f$ without requiring measurement or estimation of the frictional forces $f_c$ and $F_p$. Further, as shall be described relative to FIGS. 3 and 4, the currently preferred embodiments of the invention utilize a recursive formulation of each integral term of $\Delta l_s$ in Equation (4) to produce a cable feed rate correction signal ($\Delta(\Delta l_s)/\Delta t$) which represents the time rate of change in cable stretch that is induced both by gravity (i.e., changes in borehole inclination) and by borehole temperature gradients. This cable feed rate correction signal is summed with a cable feed rate signal (derived from the signal provided by cable measurement apparatus 22) to provide an estimate of the rate at which probe 10 is moving along borehole 12. This estimate, which takes into account the cable feed rate at wellhead 20 and both gravity and temperature induced stretching of cable 14, is hereinafter referred to as the "compensated cable feed rate."

The technique that is utilized by the invention to eliminate the need to measure or estimate frictional forces asserted on cable 14 and probe 10 as probe 10 travels through borehole 12 is based on the physicl characteristics of a borehole survey system of the type depicted in FIG. 1. In particular, it can be observed that if the friction forces exerted on cable 14 and probe 10 of the borehole survey system are constant for all positions along borehole 12, and if cable 14 is not payed out at a rate that allows the cables within borehole 12 to become slack, the friction related terms in Equation (2) will offset one another when Equation (2) is evaluated for any particular position of probe 10 (i.e., $\Delta l_f$ of Equation (4) will be equal to zero). Thus, if the friction on probe 10 and cable 14 were constant at all points along borehole 12, the rate at which probe 10 travels through the borehole would be given by compensated cable feed rate. Under such conditions, the distance between wellhead 20 and probe 10 would be equal to the definite integral of the compensated cable feed rate over the range $t_0$ to $t_1$, where $t_0$ is the time at which the survey begins and $t_1$ is the time at which the distance (path length) is measured.

Although significant variations in the friction forces can occur in a typical borehole, the variations usually occur within relatively localized regions of the borehole. For example, a probe 10 moving along the borehole 12 may encounter constrictions or gas-liquid interfaces that cause the probe to move at a rate other than the compensated cable feed rate estimate (probe 10 slowed or momentarily stuck). If this occurs while cable 14 is being payed out, cable tension is reduced and, hence, the amount of cable stretch is reduced. Conversely, if probe 10 is slowed or momentarily sticks while cable 14 is being withdrawn from borehole 12, cable tension (and, hence, cable stretch) increases. Moreover, when probe 10 passes from a region of borehole 12 that causes slowing or sticking, the support system defined by cable 14 and probe 10 in effect is in a nonequilbrium state. That is, when probe 10 becomes free to move along borehole 12 at a rate determined by the cable feed rate, probe 10 will initially move at a rate that exceeds the compensated cable feed rate until full tension is restored to cable 14 (probe 10 slowed or momentarily stuck during downward travel) or excess tension is relieved (probe 10 slowed or momentarily stuck during upward travel). Depending on the system characteristics, probe 10 may oscillate about the equilibrium position.

Another example of survey conditions in which friction forces substantially affect the rate at which probe 10 moves along borehole 12 is reversal of the direction of probe travel. Specifically, when cable reel 16 of FIG. 1 is operated to retrieve probe 10 (e.g., when the probe reaches the bottom of borehole 12) the direction in which the friction forces react on probe 10 and cable 14 reverses as the cable 14 reverses direction (i.e., during downward travel of probe 10, the friction forces in effect are directed upwardly and, when probe 10 is retrieved are directed downwardly). Thus, reversal from downward to upward probe travel places cable 14 under additional tension and results in additional cable stretch which, in turn, causes probe 10 to move at a rate different than the compensated cable feed rate until the system reaches equilibrium.

In the practice of this invention, a period of time during which probe 10 of FIG. 1 travels at a rate other than the compensated cable feed rate estimate is detected by comparing the compensated cable feed rate with an inertially derived Z-axis body coordinate velocity of probe 10 ($V_z^b$, in FIG. 2). When the magnitude of the difference between the inertially derived Z-axis probe velocity and the compensated cable feed rate exceeds a predetermined limit, the invention utilizes only the inertially derived Z-axis probe velocity to determine the distance traveled by probe 10 (by signal processing that corresponds to integration). During periods of time in which the magnitude of the difference between the inertially derived Z-axis probe velocity and the compensated cable feed rate estimate is less than the predetermined limit, the invention utilizes the compensated cable feed rate estimate to determine the long-term component of the distance traveled by probe 10 for use as the aiding signal $l_c$ (by signal processing that provides a solution to Equation (2)).

Denoting the compensated cable feed rate estimate as $v_c$, the inertially derived z-axis probe velocity as $v_z^b$ and the predetermined limit as a, the process implemented by the invention can be expressed as:

$$d_p = \int_{t_0}^{t_1} (v_1 + v_2)dt \tag{5}$$

where:

$d_p$ is equal to the distance traveled by probe 10 along borehole 12 during the time interval $t_1$ to $t_2$;

$v_1 = v_z^b$—for all periods of time within the interval $t_0 - t_1$, wherein $|v_z^b - v_c| > a$ $v_1 = 0$—otherwise; and $v_2 = v_c$—for all periods of time within the interval $t_o - t_1$, where $|v_z^b - v_c| \leqq a$ $v_2 = 0$—otherwise When $t_0$ is the time at which probe 10 begins downward travel from wellhead 20 of FIG. 1, it can be recognized that $d_p$ is equal to the long-term component of distance between probe 10 and wellhead 20 at time, $t_1$.

Figure 3:
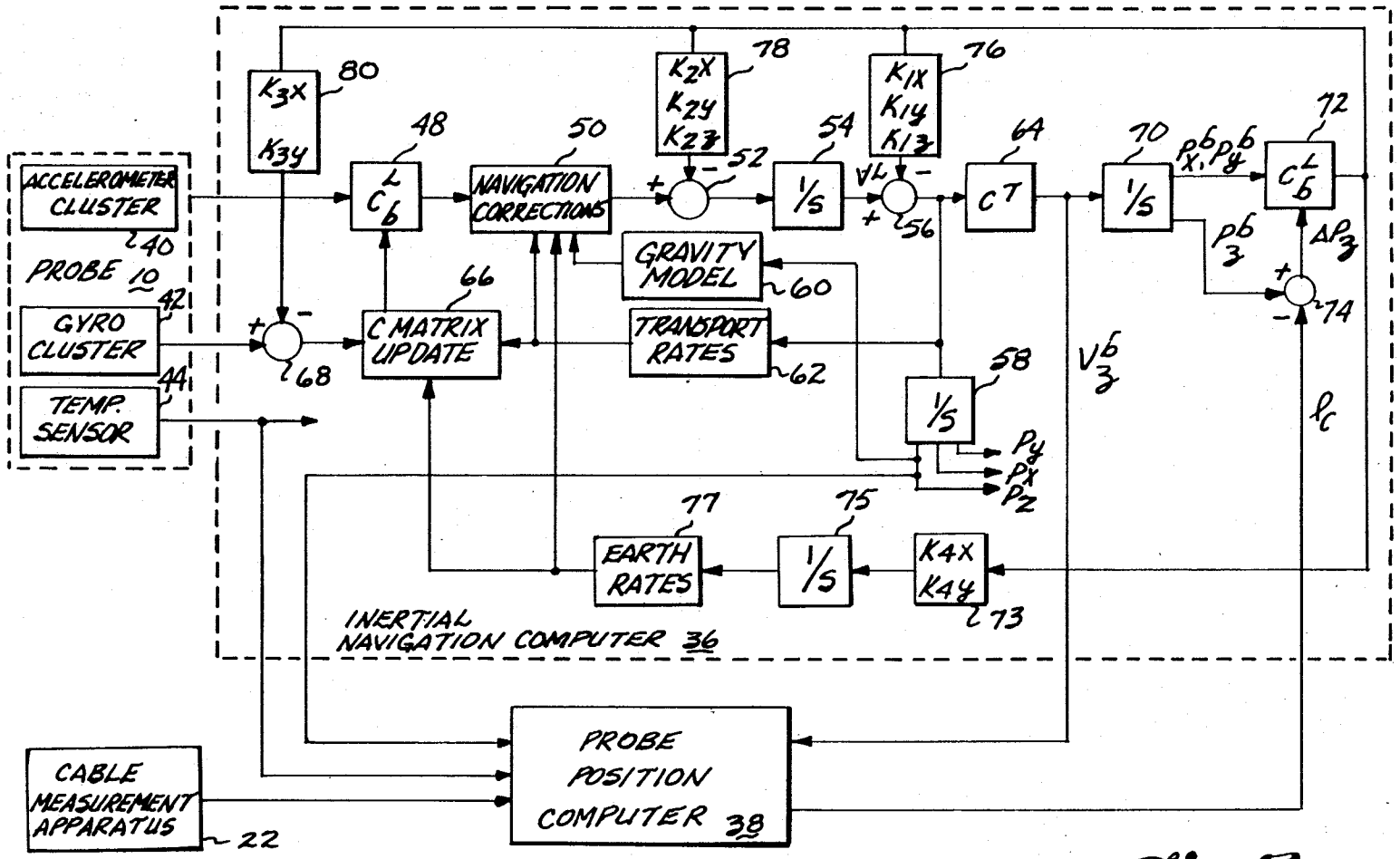
FIG. 3 is a block diagram that illustrates the signal processing that is performed in accordance with the invention.
Figure 3:
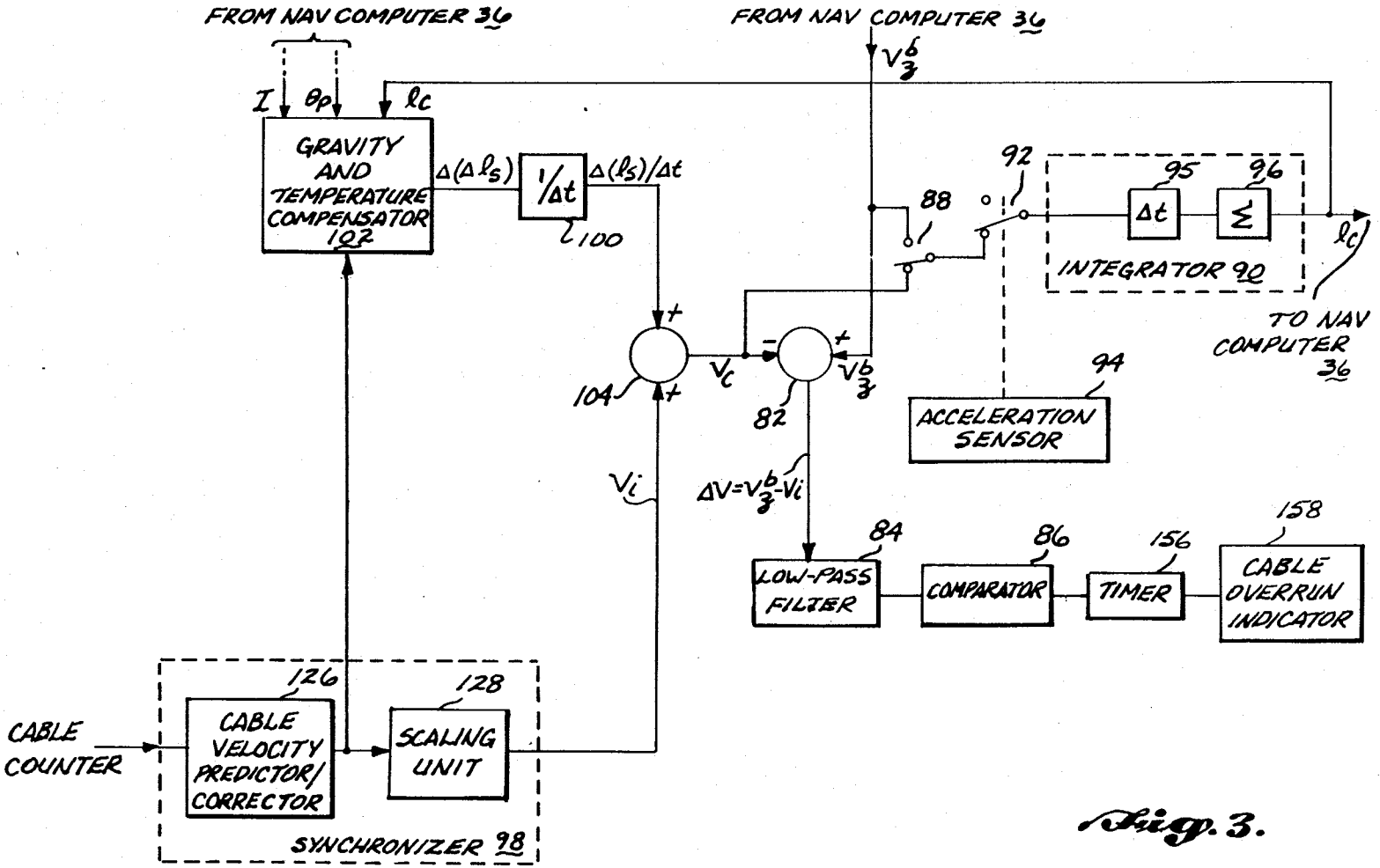

FIG. 3 illustrates the currently preferred manner of implementing the invention in conjunction with the inertial borehole navigation system of FIG. 2. In the arrangement of FIG. 3, the Z-axis body coordinate velocity signal ($v_z^b$) that is provided during each iteration of the inertial navigation signal processing (indicated in FIG. 2 by transformation block 64 of inertial navigational computer 36) and a signal representative of the compensated cable feed rate ($v_c$) are combined in signal summer 82 to provide a difference signal $\Delta v = v_z^b - v_c$. The difference, signal, $\Delta v$, is processed by a low-pass filter 84 and supplied to the input of a signal comparsator 86. In typical borehole survey applications, the cutoff frequency of low-pass filter 80 is on the order of 1 Hertz and signal comparator 82 is configured and arranged to provide an output signal when the magnitude of $\Delta v$ is approximately one foot per second (approximately 0.3 meters/second). In realizations of the invention that are implemented with discrete digital circuits, various commercially available integrated circuits can be utilized to implement low-pass filter 84 and signal comparator 86. In the currently preferred realizations of the invention, equivalent signal processing is implemented by means of conventional computer programming techniques.

Regardless of the implementation utilized, the invention determines changes in path length between wellhead 20 and probe 10 based on the inertially derived velocity, $v_z^b$, during those times when the magnitude of $\Delta v$ exceeds a predetermined limit and determines path length changes based on the compensated cable feed rate signal $v_c$, during times when $\Delta v$ is less than the predetermined limit. In the arrangement of FIG. 2 this operative aspect in the invention is schematically depicted by switch 88, which is activated by signal comparator 86 and is connected to supply the selected velocity signal ($v_z^b$ or $v_c$) to an integrator 90 via a switch 92. Switch 92 is activated by an acceleration sensor 94 to interrupt signal flow to integrator 90 whenever the acceleration signals (supplied by accelerometer cluster 40 of probe 10, FIG. 2) exceed a predetermined limit. For example, the signals supplied by currently available accelerometers typically saturate when probe 10 strikes the bottom of borehole 12. During such occurrences, utilization of the inertially derived velocity $v_z^b$ (or, alternatively, the compensated cable feed rate signal $v_c$) would cause an error in the path length estimate provided by the invention. To prevent such an error, acceleration sensor 94 activates switch 92 to disconnect the velocity signal supplied to integrator 90 to thereby maintain the path length estimate at its current value.

Various arrangements can be utilized in implementing switch 92 and acceleration sensor 94. For example, acceleration sensor 94 can be a conventional digital magnitude comparator circuit or can be implemented by signal processing within inertial navigation computer 36 or probe 10. Similarly, switch 92 can be realized by conventional solid state switching devices, or by signal processing steps within the signal processing procedure that is utilized in realizing the invention. Integrator 90 also can be realized in various conventional manners. In the currently preferred sequential processing implementations of the invention, the necessary integration is effected by conventional signal processing that basically corresponds to summation of $v\Delta t$, where v is the selected velocity ($v_z^b$ or $v_c$) and $\Delta t$ is equal to the time period between summing operations (i.e., the signal processing iteration rate). This process is indicated in FIG. 3 by multiplier 95 and summation unit 96.

It can be recognized that selectively integrating $v_z^b$ and $v_c$ in the above-described manner results in an estimate, $l_c$, of the position of probe 10 (path length between wellhead 20 and probe 10) which in the long-term is based on measured cable velocity and in the short-term is based on inertial measurement of probe velocity. It also can be recognized that estimate, $l_c$, corresponds to the length of cable 14 that actually extends between wellhead 20 and probe 10, except when probe 10 is traveling downwardly and cable is dispensed at a rate that allows slack cable to be fed into borehole 12. Thus, it can be recognized that the invention can be used in various situations that require measurement of the actual length of an elastic support cable or the position of a cable supported tool in a borehole.

The signal $l_c$ contains only limited dynamic information, but it fulfills the prime requirement for an alongbole aiding signal in that its errors are small and do not increase with time. The loops defined by $K_1$, $K_2$, and $K_3$ have long time constants compared to the dynamic modes of the cable, so the navigation computer 36 is able to supply the missing high frequency information from the gyros and accelerometers while $l_c$ corrects for their drifts.

As previously was mentioned, in the preferred embodiments of the invention, the compensated cable feed rate $v_c$ is based on a cable feed rate correction signal ($\Delta(\Delta l_s/\Delta t$ in FIG. 3) and a signal ($v_i$ in FIG. 3) that is representative of the feed rate measured by the borehole survey system cable measurement apparatus (22 in FIG. 2). In the arrangement of FIG. 3, $v_i$ is supplied by a synchronizer unit 98 and the corrected cable feed rate signal is supplied by a divider unit 100, which receives a signal $\Delta(\Delta l_s)$ from a gravity and temperature compensator 102. The signal provided by divider unit 100 ($\Delta(\Delta l_s/\Delta t)$ and $v_i$ are added within a signal summer 104 (to form the compensated cable feed rate signal) and supplied to the previously described signal summer 82.

Implementation of gravity and temperature compensator 102 by sequential signal processing can be understood in view of the relationship of Equation (4), which expresses the gravity and temperature induced cable stretch as:

$$\Delta l_s = E \int_0^{L_m} w_p \operatorname{Cos} I \, d\Sigma + E \int_0^{L_m} \int_0^{\Sigma} w_c \operatorname{Cos} I \, d\sigma d\Sigma - E \int_0^{L_m} w_p \operatorname{Cos} I \, dl - E \int_0^{L_m} \int_0^{1} w_c \operatorname{Cos} I \, d\sigma dl + \alpha \int_0^{L_m} \Delta\theta_p dl$$

To provide a signal processing sequence that is realizable within minimal memory requirements, each embodiment of the invention is configured and arranged for generating a cable feed rate correction signal $$\Delta(\Delta l)/\Delta t = E[\Delta\delta_1 + \Delta\delta_2 - \Delta\delta_3 - \Delta\delta_4]/\Delta t + \alpha(\delta_{\theta i} - \delta_{\theta(i-1)}/\Delta t$$

Specific, recursive formulations that can be utilized are as follows:

$$\Delta\delta_1 = [\delta_{1i} - \delta_{1(i-1)}] = w_p [l_{ci} \operatorname{Cos} I_i - l_{c(i-1)} \operatorname{Cos} I_{(i-1)}] \quad (6a)$$

$$\Delta\delta_2 = [\delta_{2i} - \delta_{2(i-1)}] = w_c [l_{ci} - l_{c(i-1)}] \, l_{ci} \operatorname{Cos} I_i \quad (6b)$$

$$\Delta\delta_3 = [\delta_{3i} - \delta_{3(i-1)}] = w_p [l_{ci} - l_{c(i-1)}] \operatorname{Cos} I_i \quad (6c)$$

$$\Delta\delta_4 = [\delta_{4i} - \delta_{4(i-1)}] = [l_{ci} - l_{c(i-1)}] \sum_{j=0}^{i} w_c [l_{cj} - l_{c(j-1)}] \operatorname{Cos} I_{(j-1)} \quad (6d)$$

$$\Delta\delta_\theta = [\delta_{\theta i} - \delta_{\theta(i-1)}] = \Delta_{\theta pi} (l_{ci} - l_{c(i-1)}) \quad (6e)$$

Figure 4:
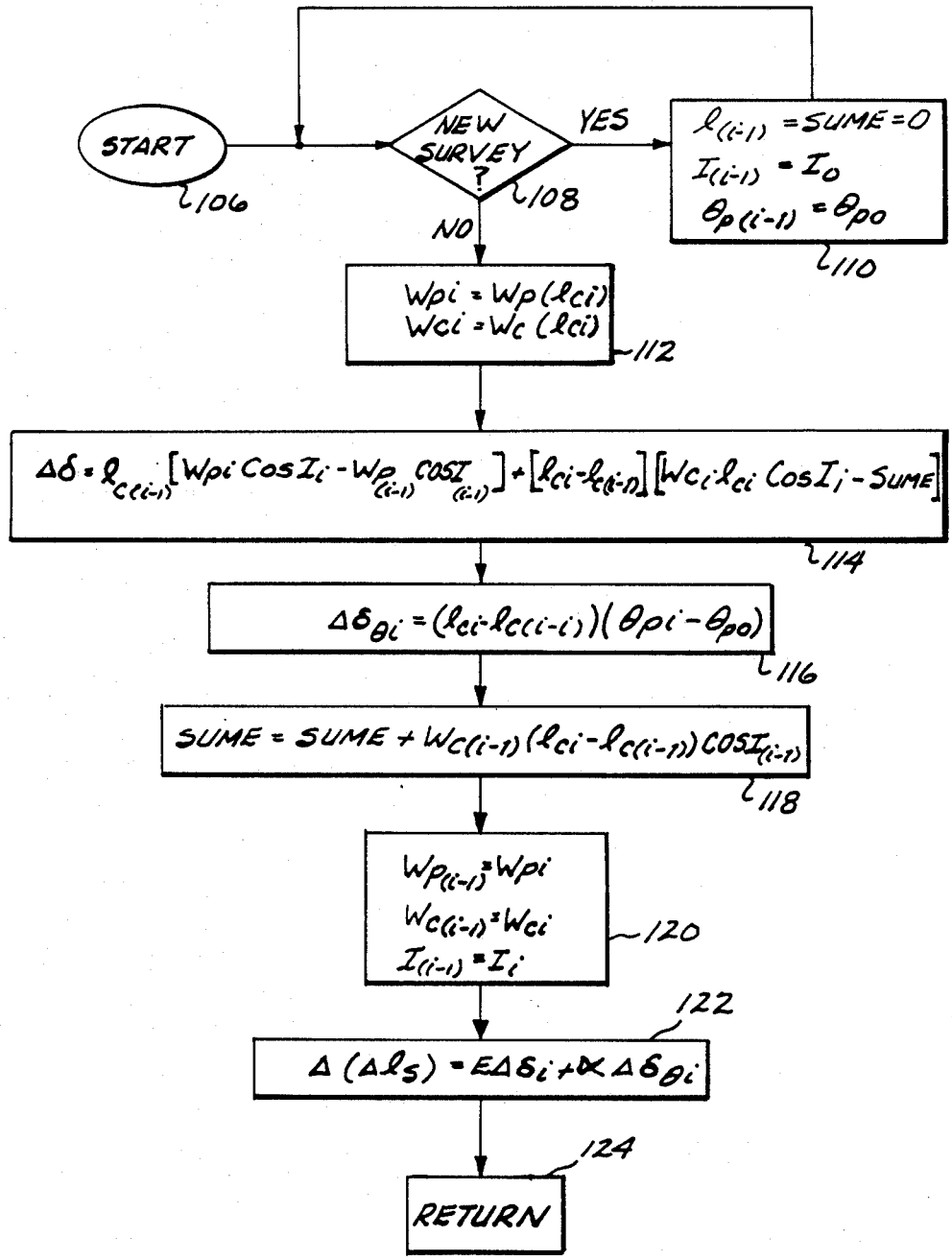
FIG. 4 illustrates a signal processing sequence that can be utilized in the practice of the invention to provide a precise estimate of the path length between the borehole survey probe and the borehole entrance oepning of FIG. 1; and, FIG. 5 illustrates a signal processing sequence suitable for synchronizing cable measurement pulses that are provided by the borehole navigation system of FIG. 1 with the signal processing that is effected by the invention.

FIG. 4 depicts a simplified flow chsart that illustrates signal processing that can be effected either in the computer that performs the inertial navigation computations (e.g., signal processor 24 of FIG. 2) or in a separate signal processor such as a microprocessor that is dedicated to accurately estimating the position of probe 10 within borehole 12. In the signal processing sequence of FIG. 4, the initial step determining the change in temperature and gravity induced cable stretch ($\Delta(\Delta l_s)$) is a determination of whether the current iteration is the first iteration of a survey operation (at decisional block 108 of FIG. 4). If a new survey operation is beginning, the computational parameters $l_{(i-1)}$; SUME; $l_{(i-1)}$; and $\theta_{p(i-1)}$ are initialized (at block 110 of FIG. 4). As is indicated in FIG. 4, $l_{(i-1)}$ and SUME are initialized at zero; $I_{(i-1)}$ is initialized to the initial inclination of borehole 12 ($I_0$) in FIG. 4; and $\theta_{p(i-1)}$ is initialized to the temperature at wellhead 20 of borehole 12 ($\theta_0$ in FIG. 4). During each iteration that follows system initialization, the weight of probe 10 and cable 14 that extends between probe 10 and wellhead 20 are determined for that particular iteration (at block 112 of FIG. 4). As is indicated in FIG. 4, both probe weight and cable weight are a function of the length of cable that extends between wellhead 20 and probe 10 (the path length $l_c$). In situations in which borehole 12 is filled with a fluid of relatively uniform density and gaseous interfaces can be neglected, the weight of probe 10 can be assumed constant (i.e., $w_p$ can be assumed equal to the actual weight of probe 10 minus the weight of the displaced fluid). Although some variationn in the weight per unit length of cable 14 occurs because of stretching, it may also be possible to assume that the weight of cable 14 that extends into borehole 12 can be assumed is equal to the unstretched weight per unit length (multiplied by the path length $l_c$) less the weight of the fluid displaced by cable 14. In the next step of the signal processing depicted in FIG. 4 (block 114), the current weight of the probe ($w_{pi}$) and the current weight of the cable ($w_{ci}$) are utilized to determine the current value of $\Delta\delta_1+\Delta\delta_2-\Delta\delta_3-\Delta\delta_4$ (Equation (6a)-(6d)). As is indicated in FIG. 4, when Equation (6a)-(6d) are expanded and combined.

$$\Delta\delta_i=l_{(i-1)}[w_{pi}\,\mathrm{Cos}\,I_i-w_{p(i-1)}\,\mathrm{Cos}\,I_{(i-1)}]+[l_i-l_{(i-1)}][w_{ci}l_1\,\mathrm{Cos}\,I_i=\mathrm{SUME}]$$

where the subscript "i" denotes the value of the indicated parameter during the current iteration of the signal processing depicted in FIG. 4 and the "$_{i-1}$" denotes the value of the indicated parameter during the previous iteration of the signal processing (i.e., the next most antecedent iteration) and SUME is a dummy variable that is utilized to provide a value that corresponds to the mathematical summation defined in Equation (6d).

The current value of $\Delta\delta_\theta$ is then determined at block 116 and the value of SUME to be used in the next iteration of the signal processing is determined at block 118. At block 120 of the signal processing sequence depicted in FIG. 4, the system variables that represent the probe weight, the cable weight and probe inclination for the current iteration are loaded into memory as the values to be used as the "i−1" values during the next iteration of the signal processing sequence of FIG. 4. Following this operation, the current value of the temperature and gravity induced cable stretch ($\Delta(\Delta l_s)$) is determined by multiplying the value obtained at block 114 by E and adding to that quantity the product of $\alpha$ and the value obtained at block 116 ($\Delta(\delta_{\theta i})$). Having determined the current change in temperature and gravity induced cable stretch, the sequence of FIG. 4 resumes with the next signal processing iteration (indicated by return block 124 and start block 106 of FIG. 4).

Although not depicted in FIG. 4, it will be noted by those skilled in the art that division of the current value of the change in temperature and gravity induced cable stretch ($\Delta(\Delta l_s)$ by the signal processing iteration interval ($\Delta t$) can be incorporated as the final step of the signal processing sequence depicted in FIG. 4. That is, although FIG. 3 depicts division by $\Delta t$ as a separate operation (in divider 100 of FIG. 3), the operation typically is performed during the signal processing sequence for determining the change in gravity and temperature induced cable stretch (indicated by gravity and temperature compensator 102 in FIG. 3).

As previously mentioned, the currently preferred embodiments of the invention that are utilized in conjunction with a borehole survey system include the provision for supplying a cable velocity signal ($v_i$) that is synchronized to the iteration rate of the signal processing utilized to practice the invention. The advantage of such synchronization can be understood by recognizing that conventional borehole survey system cable measurement apparatus (22 in FIG. 1) typically supplies an output pulse for each foot of cable that passes into or out of wellhead 20. Since the rate at which cable is fed into or withdrawn from wellhead 20 often varies during a survey operation and the nominal cable feed rate is on the order of five feet per second, the pulse repetition rate of the signal provided by the cable measurement apparatus varies with time and is generally less than five pulses per second. On the other hand, the signal processing utilized in accordance with the invention is performed at a fixed computation or iteration rate (typically 25 to 50 iterations per second). Thus, a substantial number of signal processing iterations can occur during the time interval between cable measurement pulses. If the cable feed rate is being changed and the signal processing relies on the cable feed rate that corresponds to the cable feed rate at the time of the last signal pulse from the cable measurement apparatus, the path length estimate provided by the invention may be less accurate than desired.

In the preferred embodiments of the invention, synchronizer 98 of FIG. 3 includes a cable velocity predictor/corrector 126 and a scaling unit 128 which provide the synchronized table velocity signal $v_i$ in a manner that substantially eliminates the above-discussed potential error in the borehole path length estimate ($l_c$). Specifically, cable velocity predicator/corrector 126 is arranged to estimate the cable feed rate during the time intervals between cable measurement signal pulses and scaling unit 128 controls a magnitude of the signal $v_i$ so that it is compatible with the cable measurement correction signal $\Delta(\Delta l_s)$.

It will be recognized that various implementations of cable velocity predictor/corrector 126 and scaling unit 128 are possible. In the currently preferred realization of the invention, cable velocity predicator/corrector 126 processes the cable counter signals supplied by the cable measurement apparatus using a first order slope prediction technique to provide a predicted velocity during each signal processing iteration. The velocity predicted by the first order estimization is corrected by integrating the predicted velocities and periodically comparing the value obtained with the cable length measurement provided by counting the pulses provided by the cable measurement apparatus.

More specifically, the rate at which cable 14 passes into or out of wellhead 20 of FIG. 1 can be defined as $V_N=K_c/S_N\,\Delta t$, where $K_c$ represents the incremental cable length that passes over idler pulley 18 of FIG. 1 when idler pulley 18 rotates by the amount required to produce one signal pulse; $\Delta t$ represents the signal processing cycle time (i.e., time interval between a particular step of successive iterations) and $S_N$ represents the number of signal processing iterations that occurred between the most recent (Nth) signal pulse supplied by measurement apparatus 22 and the next most antecedent (Nth−1) signal pulse supplied by measurement apparatus 22. Utilizing this relationship, it can be shown that a synchronized cable velocity signal, $v_{cm}$, that can be satisfactorily utilized in the practice of the invention is given by the expression $$v_i = [V_N + (V_N - V_{N-1})i/S_N] + \frac{1}{\tau}\left[K_c(N + 1/2) - \left(\sum_{m=1}^{N}\sum_{j=1}^{S_m} V_j\Delta t + \sum_{j=1}^{i-1} V_j\Delta t\right)\right] \quad (7)$$

Where: $\tau$ is a selected time constant (e.g., approximately 60 for an embodiment of the invention that operates at a signal processing iteration rate of approximately 50 hz); and i represents the number of signal processing iterations that have occurred since the time at which cable measurement apparatus 24 supplied a signal pulse.

The first term of equation 7 corresponds to a prediction of the cable velocity for the current signal processing interval with a predicted value being based on the most recent and next most antecedent signal pulses supplied by measurement apparatus 22. The second term of Equation 7 is a correction term that provides compensation so that the synchronization process is responsive to relatively abrupt changes in the rate at which cable 14 is fed into or extracted from wellhead 20 (i.e., so that the long-term integral of the signal pulses supplied by cable measurement apparatus 22 is substantially equal to the corresponding long-term integral of the synchronized cable velocity signals).

Figure 5:
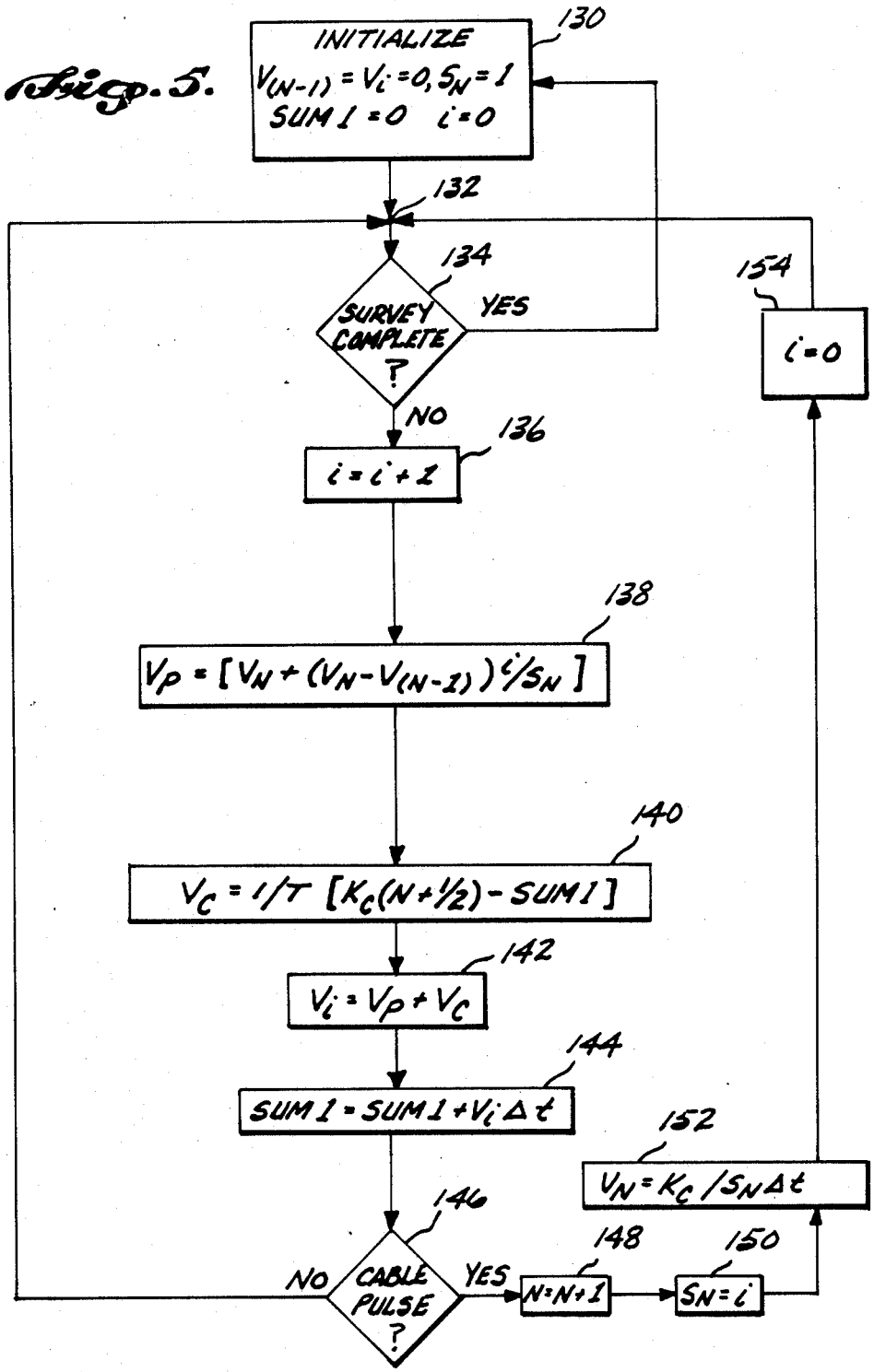

FIG. 5 illustrates a simplified flow chart for signal processing that determines the corrected cable velocity $v_i$ in accordance with Equation 7. In the signal processing sequence of FIG. 5, each time a survey is initiated the values of $V_{N-1}$ and $V_i$ are set equal to zero and the value of $S_N$ is set equal to 1. In addition, the value of a computational variable SUM1, which corresponds to the summation term of Equation 7 is initialized at zero. As is indicated at decisional block 134 of FIG. 5, the first step of the depicted sequence consists of determining whether the borehole survey in progress has been completed (e.g., whether probe 10 has reached the bottom of borehole 12). Various signals can be utilized to indicate that a borehole survey is complete. For example, when probe 10 has reached the bottom of borehole 12, the system operator can activate a switch that supplies an electrical signal. Alternatively, in some situations, the signal generated by accelerometer sensor 94 of FIG. 3 can be employed. In any case if the current survey has been completed, the above-discussed variables are initialized (at block 130) in preparation for the next survey operation.

If the current survey is not complete, the value of i is incremented by numeral 1 (at block 136). Since, as described below, i is reset to zero each time a cable measurement signal pulse is received (e.g. from cable measurement apparatus 22 of FIG. 1), i is equal to the number of iterations performed since cable measurement apparatus 22 supplied a cable measurement signal pulse.

At block 138 of FIG. 5, the current value of the prediction term (first term) of Equation 7 is determined. The current value of the correction term (second term of Equation 7) is then determined at block 140 of FIG. 3. In this determination, the computational variable SUM1 provides a value that is equal to the summation of $v_i\,\Delta t$ over the time in which the survey has been in progress. The value of $\tau$ (which determines the relative weighting of the correction term) can be supplied either from an erasable programmable memory or can be supplied by the system operator by means of a keyboard or set of switches that is activated at the time the borehole survey is initiated. At block 142 of FIG. 4, the current value of $v_i$ is determined by summation of the predicated and corrected velocity terms (from blocks 138 and 140). Next, the computational variable SUM1 is updated for the next iteration of the depicted signal processing by adding $v_i\,\Delta t$ to the existing value of SUM1.

Next, it is determined whether or not a cable measurement pulse currently is being supplied by cable measurement apparatus 22 (decisional block 146 of FIG. 5). If a cable measurement pulse is not present, the sequence for that particular iteration is complete and the sequence is repeated (beginning at point 132) during the next iteration. If a cable measurement pulse is present, the value of N (which represents the number of cable measurement pulses supplied during a survey operation) is incremented by 1 (at block 148); the value of $S_N$ is set equal to i (at block 150); the value of $V_N$ to be utilized during the next iteration is computed (at block 152); and the value of is set equal to zero. The sequence is then repeated (beginning at point 132).

In addition to providing an accurate estimate of the path length between probe 10 and wellhead 20, the invention can be configured to provide an indication that continued pay out of cable 14 may result in cable becoming slack and fouling in borehole 12 (or, conversely, the continued attempt to retrieve a probe 10 that is fouled in borehole 12 may cause parting of cable 14). This aspect of the invention is illustrated in FIG. 3 by a timer circuit 156, which is activated each time signal comparator 86 detects that $\Delta v$ exceeds the previously discussed predetermined limit (i.e., that the inertially derived Z axis velocity of probe 10 differs from the compensated cable feed rate velocity by more than the predetermined limit). When $\Delta v$ exceeds the predetermined limit for predetermined period of time, timer 156 activates a cable overrun indicator 158. Various arrangements known to those skilled in the art can be utilized to implement timer 156 and cable overrun indicator 158. In this regard, since the invention is arranged for sequential signal processing, timer 156 is essentially a counter that counts the number of signal processing iterations in which the magnitude of $\Delta v$ exceeds the predetermined limit and activates cable overrun indicator 158 if a predetermined count is reached. Cable overrun indicator 158 can be a visual display such as a lamp or an aural warning device.

It will be recognized by those skilled in the art that the embodiment of the invention that is disclosed herein is exemplary in nature and that various modifications and changes can be made without departing from the spirit and scope of the invention. For example, as previously mentioned, the invention can be employed in various other applications in which it is desirable or necessary to determine the true length of an elastic cable that supports an object such as a probe or other instrument package. As also was mentioned, the invention can be implemented readily in various signal processing environments, including programmed digital computers and microprocessors or by dedicated digital circuit designs. Even further, it should be recognized that various changes and substitutions can be made in the signal synchronizationn and recursive signal formulations discussd herein as long as the signal processing provides a satisfactory estimate or approximation to the herein discussed system relationships.

The embodiments of the invention in which an exclusive property or privilege is claimed are defined as follows:

1. A method for determining the path length between a borehole entrance opening and a probe that is suspended to move through the borehole by an elastic cable, said method comprising:

(a) generating a cable feed rate signal representative of the current rate at which said cable is moving past said entrance opening of said borehole;

(b) generating a cable feed rate correction signal representative of current changes in the length of said cable that are induced by temperature and inclination of the portion of said borehole that surrounds said probe;

(c) combining said cable feed rate signal and said cable feed rate correction signal to provide a compensated cable feed rate signal;

(d) generating a probe velocity signal representing the current rate at which said probe is moving along said borehole;

(e) detecting whether the magnitude of the difference between said probe velocity signal and said compensated feed rate signal exceeds a predetermined value;

(f) selecting said compensated feed rate signal when said magnitude of the difference between said probe velocity signal and said compensated cable feed rate does not exceed said predetermined value;

(g) selecting said probe velocity signal when said magnitude of the difference between said probe velocity signal and said compensated feed rate signal exceeds said predetermined value;

(h) periodically repeating steps (a) through (g); and, (i) determining the integral with respect to time of the selected one of said probe velocity signal and said compensated cable feed rate signal as said steps (a) through (g) are periodically repeated.

2. The method of claim 1, wherein said step of generating said cable feed rate correction signal comprises the steps of:

(a) measuring the temperature of the region of said borehole that surrounds said probe as said probe is moved along said borehole to obtain a signal representative of temperature;

(b) measuring the inclination of the region of said borehole that surrounds said probe as said probe is moved along said borehole to obtain a signal representative of probe inclination;

(c) processing said signal representative of temperature and said signal representative of probe inclination to provide a cable stretch correction signal defined by the expression $\Delta l_s = E[\Delta\delta_1 + \Delta\delta_2 - \Delta\delta_4] + \alpha\Delta\delta_\theta$ where E represents the elastic compliance of said cable, $\alpha$ represents the temperature coefficient of said cable and where $\Delta\delta_1$, $\Delta\delta_2$, $\Delta\delta_3$, $\Delta\delta_\theta$ are recursive estimates that represent the gravity and temperature induced changes in the length of said cable; and (d) determining the correction signal by dividing said cable stretch correction by $\Delta t$, where $\Delta t$ is the time elapsing between each periodic selection of said compensated cable feed rate signal and said probe velocity signal.

3. The method of claim 2, wherein $\Delta\delta_1$ is repetitively determined as a series of sequential values in a sequential signal processing method and wherein each sequential value of $\Delta\delta_1$ is defined by the expression:

$$\Delta\delta_1 = [\delta_{1i} - \delta_{1(i-1)}] = w_p[l_{ci} \operatorname{Cos} I_i - l_{c(i-1)} \operatorname{Cos} I_{(i-1)}]$$

where $w_p$ represents the weight of the borehole probe, $l_c$, represents the estimated length of said length of cable supporting said borehole probe, I represents the inclination of borehole, and where the subscripts i and (i−1) respectively indicate the value of an indicated variable during the current and next-most antecedent evaluation of said sequential signal processing method.

4. The method of claim 2, wherein $\Delta\delta_2$ is repetitively determined as a series of sequential values in a sequential signal processing method and wherein each sequential value of $\Delta\delta_2$ is defined by the equation:

$$\Delta\delta_2 = [\delta_{2i} - \delta_{2(i-1)}] = w_c[l_{ci} - l_{c(i-1)}] l_{ci} \operatorname{Cos} I_i$$

where $w_c$ represents the weight per unit length of the cable supporting the borehole probe, $l_c$ represents the estimated length of said length of cable supporting said borehole probe, I represents the inclination of said borehole, and where the subscripts i and (i−1) respectively indicate the value of an indicated variable during the current and next-most antecedent evaluation of said sequential signal processing method.

5. The method of claim 2, wherein $\Delta\delta_3$ is repetitively determined as a series of sequential values in a sequential signal processing method and wherein each sequential value of $\Delta\delta_3$ is defined by the equation:

$$\Delta\delta_3 = [\delta_{3i} - \delta_{3(i-1)}] = w_p[l_{ci} = l_{c(i-1)}] \operatorname{Cos} I_i$$

where $w_p$ represents the weight of the borehole probe, $l_c$ represents the estimated length of said length of cable supporting said borehole probe, I represents the inclination of said borehole, and where the subscripts i and (i−1) respectively indicate the value of an indicated variable during the current and next-most antecedent evaluation of said sequential signal processing method.

6. The method of claim 2, wherein $\Delta\delta_4$ is repetitively determined as a series of sequential values in a sequential signal processing method and wherein each sequential value of $\Delta\delta_4$ is defined by the equation:

$$\Delta\delta_4 = [\delta_{4i} - \delta_{4(i-1)}] = [l_{ci} - l_{c(i-1)}] \sum_{j=0}^{i} w_c [l_{cj} - l_{c(j-1)}] \operatorname{Cos} I_{(j-1)}$$

where $w_c$ represents the weight per unit length of the cable supporting the borehole probe, $l_c$ represents the estimated length of said length of cable supporting said borehole probe, I represents the inclination of said borehole, and where the subscripts i and (i−1) respectively indicate the value of an indicated variable during the current and next-most antecedent evaluation of said sequential signal processing method.

7. The method of claim 2, wherein $\Delta\delta_4$ is repetitively determined as a series of sequential values in a sequential signal processing method and wherein each sequential value of $\Delta\delta_\theta$ is defined by the equation:

$$\Delta\delta_{74}=[\delta_{74\,i}-\delta_{\theta(i-1)}]=\Delta_{\theta pi[(i-1)]}(l_{ci}-l_{c(i-1)})$$

where $\Delta_{\theta p}$ represents change in probe temperature from that at the wellhead, $l_c$ represents the estimated length of said length of cable supporting said borehole probe and where the subscripts i and (i−1) respectively indicate the value of an indicated variable during the current and next-most antecedent evaluation of said sequential signal processing method.

8. The method of claim 2, wherein $\Delta\delta_1$ $\Delta\delta_2$, $\Delta\delta_3$, $\Delta\delta_4$ and $\Delta\delta_\theta$ are each repetitively determined as a series of sequential values in a sequential signal processing method and wherein each sequential value of $\Delta\delta_1$, $\Delta\delta_2$, $\Delta\delta_3$ $\Delta\delta_4$ and $\Delta\delta_\theta$ is respectively defined by the expressions:

$$\Delta\delta_1 = [\delta_{1i} - \delta_{1(i-1)}] = w_p\,[l_{ci}\,\mathrm{Cos}\,I_i - l_{c(i-1)}\,\mathrm{Cos}\,I_{(i-1)}]$$

$$\Delta\delta_2 = [\delta_{2i} - \delta_{2(i-1)}] = w_c\,[l_{ci} - l_{c(i-1)}]\,l_{ci}\,\mathrm{Cos}\,i_i$$

$$\Delta\delta_3 = [\delta_{3i} - \delta_{3(i-1)}] = w_p\,[l_{ci} - l_{c(i-1)}]\,\mathrm{Cos}\,I_i$$

$$\Delta\delta_4 = [\delta_{4i} - \delta_{4(i-1)}] = [l_{ci} - l_{c(i-1)}]\sum_{j=0}^{i} w_c\,[l_{cj} - l_{c(j-1)}]\,\mathrm{Cos}\,I_{(j-1)}$$

$$\Delta\delta_\theta = [\delta_{\theta i} - \delta_{\theta(i-1)}] = \Delta_{\theta pi[(i-1)]}\,(l_{ci} - l_{c(i-1)})$$

where $w_p$ represents the weight of the borehole probe, $l_c$ represents the estimated length of said length of cable supporting said borehole probe, $w_c$ represents the weight per unit length of said cable supporting said borehole probe, I represents the inclination of said borehole, and where the subscripts i and (i−1) respectively indicate the value of an indicated variable during the current and next-most antecedent evaluation of said sequential signal processing method.

9. The method of claim 2, wherein said step of generating a cable feed rate signal comprises the step of generating a cable measurement signal pulse each time a predetermined incremental length of cable passes by said entrance of said borehole, said cable measurement pulse being used to generate the cable feed rate signal, and wherein said method is performed repetitively at a cycle rate of $1/\Delta t$, said method further including the step of supplying a cable velocity signal, $v_i$, at said cyclic rate $1/\Delta t$, said cable velocity signal representing a predicted value of the rate at which said cable passes by said borehole entrance opening during periods of time that elapse between successive ones of said cable measurement pulses.

10. The method of claim 9, wherein said cable velocity signal, $v_i$ is defined by the mathematical expression:

$$V_i = [V_N + (V_N - V_{N-1})i/S_N] + \frac{1}{\tau}\left[K_c(N + 1/2) - \left(\sum_{m=1}^{N}\sum_{j=1}^{S_m} V_j\Delta t + \sum_{j=1}^{i-1} V_j\Delta t\right)\right]$$

where $\tau$ is a selected time constant, i represents the number of signal processing iterations that have occurred since the time at which a cable measurement signal pulse was last generated, n is the total number of cable measurement signal pulses generated $K_c$ represents the incremental length of said cable that passes into said borehole during the time interval between two consecutive cable measurement signal pulses, $S_m$ is the number of signal processing iterations in the mth cable measurement signal pulse interval, $S_N$ represents the number of signal processing iterations that occurred between the most recent and next-most antecedent cable measurement signal pulses, $V_N$ is defined by the mathematical expression $V_N=K_c/(S_N\Delta t)$ and $V_{N-1}$ is defined by the mathematical expression $V_{N-1}=K_c/(S_{N-1}\Delta t)$, $S_{N-1}$ representing the number of signal processing iterations that occurred between the next-most recent and next-most antecedent cable measurement signal pulses.

11. The method of claim 10, wherein each sequential value of $\Delta\delta_1$ is defined by the expression:

$$\Delta\delta_1=[\delta_{1i}-\delta_{1(i-1)}]=w_p[l_{ci}\,\mathrm{Cos}\,I_i-l_{c(i-1)}\,\mathrm{Cos}\,I_{(i-1)}]$$

where $w_p$ represents the weight of the borehole probe, $l_c$ represents the estimated length of said length of cable supporting said borehole probe, I represents the inclination of said borehole, and where the subscripts i and (i−1) respectively indicate the value of an indicated variable during the current and next-most antecedent evaluation of said sequential signal processing method.

12. The method of claim 10, wherein each sequential value of $\Delta\delta_2$ is defined by the equation:

$$\Delta\delta_2=[\delta_{2i}-\delta_{2(i-1)}]=w_c[l_{ci}-l_{ci(i-1)}]l_{ci}\,\mathrm{Cos}\,I_i$$

where $w_c$ represents the weight per unit length of the cable supporting the borehole probe, $l_c$ represents the estimated length of said length of cable supporting said borehole probe, I represents the inclination of said borehole and where the subscripts i and (i−1) respectively indicate the value of an indicated variable during the current and next-most antecedent evaluation of said sequential signal processing method.

13. The method of claim 10, wherein each sequential value of $\Delta\delta_3$ is defined by the equation:

$$\Delta\delta_3=[\delta_{3i}-\delta_{3(i-1)}]=w_p[l_{ci}-l_{c(i-1)}]\,\mathrm{Cos}\,I_i$$

where $w_p$ represents the weight of the borehole probe, $l_c$ represents the estimated length of said length of cable supporting said borehole probe, I represents the inclination of said borehole, and where the subscripts i and (i−1) respectively indicate the value of an indicated variable during the current and next-most antecedent evaluation of said sequential signal processing method.

14. The method of claim 10, wherein each sequential value of $\Delta\delta_4$ is defined by the equation:

$$\Delta\delta_4 = [\delta_{4i} - \delta_{4(i-1)}] = [l_{ci} - l_{c(i-1)}]\sum_{j=0}^{i} w_c\,[l_{cj} - l_{c(j-1)}]\mathrm{Cos}\,I_{(j-1)}$$

where $w_c$ represents the weight per unit length of the cable supporting the borehole probe, $l_c$ represents the estimated length of said length of cable supporting said borehole probe, I represents the inclination of said borehole, and where the subscripts i and (i−1) respectively indicate the value of an indicated variable during the current and next-most antecedent evaluation of said sequential signal processing method.

15. The method of Claim 10, wherein each sequential value of $\Delta\delta_\theta$ is defined by the equation:

$$\Delta\delta_\theta=[\delta_{\theta i}-\delta_{\theta(i-1)}]=\Delta_{\theta p i}(l_{ci}-l_{c(i-1)})$$

where $\Delta\delta_\theta$ represents the change in probe temperature from that at the wellhead, $l_c$ represents the estimated length of said length of cable supporting said borehole probe and where the subscripts i and (i−1) respectively indicate the value of an indicated variable during the current and next-most antecedent evaluation of said sequential signal processing method.

16. The method of claim 10, wherein each sequential value of $\Delta\delta_1$, $\Delta\delta_2$, $\Delta\delta_3$, $\Delta\delta_4$ and $\Delta\delta_\theta$ is respectively defined by the expressions:

$$\Delta\delta_1 = [\delta_{1i} - \delta_{1(i-1)}] = w_p\,[l_{ci}\,\mathrm{Cos}\,I_i - l_{c(i-1)}\,\mathrm{Cos}\,I_{(i-1)}]$$

$$\Delta\delta_2 = [\delta_{2i} - \delta_{2(i-1)}] = w_c\,[l_{ci} - l_{c(i-1)}]\,l_{ci}\,\mathrm{Cos}\,I_{(i-1)}$$

$$\Delta\delta_3 = [\delta_{3i} - \delta_{3(i-1)}] = w_p\,[l_{ci} - l_{c(i-1)}]\,\mathrm{Cos}\,I_i$$

$$\Delta\delta_4 = [\delta_{4i} - \delta_{4(i-1)}] = [l_{ci} - l_{c(i-1)}]\sum_{j=0}^{i}[w_c\,l_{cj} - l_{c(j-1)}]\,\mathrm{Cos}\,I_{(j-1)}$$

$$\Delta\delta_\theta = [\delta_{\theta i} - \delta_{\theta(i-1)}] = \Delta_{\theta p i[(i-1)]}\,(l_{ci} - l_{c(i-1)})$$

where $w_p$ presents the weight of the borehole probe, $l_c$ represents the estimated length of said length of cable supporting said borehole probe, $w_c$ represents the weight per unit length of said cable supporting said borehole probe, I represents the inclination of said borehole, and where the subscripts i and (i−1) respectively indicate the value of an indicated variable during the current and next-most antecedent evaluation of said sequential signal processing method.

17. The method of claim 2, further comprising the steps of:

(a) measuring the length of any time interval in which said magnitude of said difference between said probe velocity signal and said compensated cable feed rate signal exceeds said predetermined value; and, (b) generating a humanly perceivable signal when said length of time exeeds a predetermined value.

18. The method of claim 1, wherein said step of generating said probe velocity signal comprises the steps of:

(a) generating a signal representative of the acceleration of said probe along a coordinate axis that corresponds to the direction in which said probe moves along said borehole; and, (b) integrating said signal representative of said acceleration of said probe to produce said probe velocity signal.

19. The method of claim 18, wherein said step of generating a cable feed rate signal comprises the step of generating a cable measurement signal pulse each time a predetermined incremental length of cable passes by said entrance of said borehole, said cable measurement pulse being used to generate said cable feed rate signal, and wherein said method is performed repetitively at a cycle rate of $1/\Delta t$, said method further including the step of supplying a cable velocity signal, $v_i$, at said cyclic rate $1/\Delta t$, said cable velocity signal representing a predicted value of the rate at which said cable passes by said borehole entrance opening during periods of time that elapse between successive ones of said cable measurement pulses.

20. The method of claim 19, wherein said cable velocity signal, $v_i$ is defined by the mathematical expression:

$$v_i = [V_N + V_N - V_{N-1}\,i/S_N] + \frac{1}{\tau}\left[K_c(N+1/2) - \left(\sum_{m=1}^{N}\sum_{j=1}^{S_m} V_j\Delta t + \sum_{j=1}^{i-1} V_j\Delta t\right)\right],$$

where $\tau$ is a selected time constant, i represents the number of signal processing iterations that have occurred since the time at which a cable measurement signal pulse was last generated, N is the total number of cable measurement signal pulses generated, $K_c$ represents the incremental length of said cable that passes into said borehole during the time interval between two consecutive cable measurement signal pulses, $S_m$ is the number of signal processing iterations in the mth cable measurement signal pulse interval, $S_N$ represents the number of signal processing iterations that occurred between the most recent and next-most antecedent cable measurement signal pulses, $V_N$ is defined by the mathematical expression $V_N=K_c/(S_N\Delta t)$, and $V_{N-1}$ is defined by the mathematical expression $V_{N-1}=K_c/(S_{N-1}\Delta t)$, $S_{N-1}$ representing the number of signal processing iterations that occurred between the next-most recent and next-most antecedent cable measurement signal pulses.

21. The method of claim 20, wherein each sequential value of $\Delta\delta_1$ is defined by the expression:

$$\Delta\delta_1=[\delta_{1i}-\delta_{1(i-1)}]=w_p[l_{ci}\,\mathrm{Cos}\,I_i-l_{c(i-1)}\,\mathrm{Cos}\,I_{(i-1)}]$$

where $w_p$ represents the weight of the borehole probe, $l_c$ represents the estimated length of said length of cable supporting said borehole probe, I represents the inclination of said borehole, and where the subscripts i and (i−1) respectively indicate the value of an indicated variable during the current and next-most antecedent evaluation of said sequential signal processing method.

22. The method of claim 20, wherein each sequential value of $\Delta\delta_2$ is defined by the equation:

$$\Delta\delta_2=[\delta_{2i}-\delta_{2(i-1)}]=w_c[l_{ci}-l_{c(i-1)}]l_{ci}\,\mathrm{Cos}\,I_i$$

where $w_c$ represents the weight per unit length of the cable supporting the borehole probe, $l_c$ represents the estimated length of said length of cable supporting said borehole probe, I represents the inclination of said borehole and where the subscripts i and (i−1) respectively indicate the value of an indicated variable during the current and next-most antecedent evaluation of said sequential signal processing method.

23. The method of claim 20, wherein each sequential value of $\Delta\delta_3$ is defined by the equation:

$$\Delta\delta_3=[\delta_{3i}-\delta_{3(i-1)}]=w_p[l_{ci}-l_{c(i-1)}]\,\mathrm{Cos}\,I_i$$

where $w_p$ represents the weight of the borehole probe, $l_c$ represents the estimated length of said length of cable supporting said borehole probe, I represents the inclination of said borehole, and where the subscripts i and (i−1) respectively indicate the value of an indicated variable during the current and next-most antecedent evaluation of said sequential signal processing method.

24. The method of claim 20, wherein each sequential value of $\Delta\delta_4$ is defined by the equation:

$$\Delta\delta_4 = [\delta_{4i} - \delta_{4(i-1)}] = [l_{ci} - l_{c(i-1)}] \sum_{j=0}^{i} w_c [l_{cj} - l_{c(j-1)}] \text{Cos } I_{(j-1)}$$

where $w_c$ represents the weight per unit length of the cable supporting the borehole probe, $l_c$ represents the estimated length of said length of cable supporting said borehole probe, I represents the inclination of said borehole and where the subscripts i and (i−1) respectively indicate the value of an indicated variable during the current and next-most antecedent evaluation of said sequential signal processing method.

25. The method of claim 20, wherein each sequential value of $\Delta\delta_\theta$ is defined by the equation:

$$\Delta\delta_\theta = [\delta_{\theta i} - \delta_{\theta(i-1)}] = \Delta_{\theta p i[(i-1)]}(l_{ci} - l_{c(i-1)})$$

where $\Delta_{\theta p}$ represents the change in probe temperature from that at the wellhead, $l_c$ represents the estimated length of said length of cable supporting said borehole probe and where the subscripts i and (i−1) respectively indicate the value of an indicated variable during the current and next-most antecedent evaluation of said sequential signal processing method.

26. The method of claim 20, wherein each sequential value of $\Delta\delta_1$, $\Delta\delta_2$, $\Delta\delta_3$, $\Delta\delta_4$ and $\Delta\delta_\theta$ is respectively defined by the expressions:

$$\Delta\delta_1 = [\delta_{1i} - \delta_{1(i-1)}] = w_p [l_{ci} \text{ Cos } I_i - l_{c(i-1)} \text{ Cos } I_{(i-1)}]$$

$$\Delta\delta_2 = [\delta_{2i} - \delta_{2(i-1)}] = w_c [l_{ci} - l_{c(i-1)}] \, l_{ci} \text{ Cos } I_{(i-1)}$$

$$\Delta\delta_3 = [\delta_{3i} - \delta_{3(i-1)}] = w_p [l_{ci} - l_{c(i-1)}] \text{ Cos } I_i$$

$$\Delta\delta_4 = [\delta_{4i} - \delta_{4(i-1)}] = [l_{ci} - l_{c(i-1)}] \sum_{j=0}^{i} w_c [l_{cj} - l_{c(j-1)}] \text{ Cos } I_{(j-1)}$$

$$\Delta\delta_\theta = [\delta_{\theta i} - \delta_{\theta(i-1)}] = \Delta_{\theta p i[(i-1)]} (l_{ci} - l_{c(i-1)})$$

where $w_p$ represents the weight of the borehole probe, $l_c$ represents the estimated length of said length of cable supporting said borehole probe, $w_c$ represents the weight of said cable supporting said borehole probe, I represents the inclination of said borehole, and where the subscripts i and (i−1) respectively indicate the value of an indicated variable during the current and next-most antecedent evaluation of said sequential signal processing method.

27. A borehole survey system comprising:

a probe configured and arranged for passage along said borehole, said probe including accelerometer means for supplying signals representative of the acceleration of said probe along said borehole, gyro means for supplying signals representative of the inclination of said probe as it passes along said borehole and temperature sensing means for sensing the temperature of said borehole;

an elastic cable attached to said probe for raising and lowering said probe through said borehole;

means for paying out and retrieving said elastic cable to lower said probe into and retrieve said probe from said borehole;

means for measuring the rate at which said cable passes the entrance opening of said borehole when said probe is lowered into and retrieved from said borehole;

first signal processing means responsive to a signal representative of the path length that extends between said probe and the entrance opening of said borehole, said first signal processing means also being responsive to said signals supplied by said accelerometer means, said gyro means and said temperature sensing means, said first signal processing means being configured and arranged for supplying signals that collectively represent the path of said borehole, said first signal processing means further being configured and arranged for supplying a signal representative of the velocity of said probe along said borehole; and second signal processing means for supplying said signal representative of the path length that extends between said probe and said entrance opening of said borehole, said second signal processing means being responsive to said signal representative of the rate at which said cable passes by said entrance opening of said borehole and said signal representative of said velocity at which said probe moves along said borehole, said second signal processing means being configured and arranged for detecting whether the difference between said velocity at which said probe moves along said borehole and said rate at which said cable passes into said borehole exceeds a predetermined value and being configured and arranged for supplying a compensated cable feed rate signal representative of changes in the length of cable that extends between said entrance opening of said borehole and said probe that are caused by changes in temperature and inclination of said borehole; said second signal processing means further being configured and arranged for supplying said signal representative of path length of said cable that extends between said entrance opening of said borehole and said probe as the integral with respect to time of said compensated cable feed rate signal during intervals of time in which said difference between said velocity at which said probe moves along said borehole and said compensated cable feed rate signal is less than said predetermined value and for supplying said signal representative of said path length extending between said entrance opening of said borehole and said probe as the integral with respect to time of said rate at which said probe moves along said borehole during intervals of time in which said difference between said rate at which said probe moves along said borehole and said compensated cable feed rate signal exceeds said predetermined value.

28. The borehole survey system of claim 27, wherein said system is fixed in the probe and wherein:

said first signal processing means is configured and arranged for supplying an inertially derived position signal representing the distance between said entrance opening of said borehole and said probe;

said first signal processing means is responsive to an error signal representative of the difference between said inertially derived position signal and said signal representative of said path length that extends between said entrance opening of said borehole and said probe; and, said first signal processing means is configured and arranged for improving the accuracy of said signals that collectively represent the path of said borehole on the basis of the magnitude of said error signal.

29. The borehole survey system of claim 28, wherein each of said first and second signal processing means comprise a programmed digital computing device.

30. The borehole survey system of claim 28, wherein said first and second signal processing means comprise a single programmed digital computing device.

31. The borehole survey system of claim 30, wherein:

said means for measuring the rate at which said cable passes the entrance opening of said borehole when said probe is lowered into and retrieved from said borehole includes means for supplying a signal pulse to said second signal processing means each time a predetermined incremental length of cable passes by said entrance opening of said borehole;

said programmed digital computing device operates at a predetermined iteration rate; and said second signal processing means is responsive to said signal pulses indicating that a predetermined length of cable has passed said entrance opening of said borehole and is configured and arranged for supplying a signal representative of the rate at which cable passes by said entrance opening of said borehole during each iteration of said program digital computing device.

32. The borehole survey system of claim 30, further comprising means for determining the length of each time interval in which the difference between the velocity at which said probe moves along said borehole and said compensated cable feed rate signal that exceeds a first predetermined value and means for supplying a warning signal when said length of time exceeds a second predetermined value.

* * * * *

UNITED STATES PATENT AND TRADEMARK OFFICE

CERTIFICATE OF CORRECTION

PATENT NO. : 4,797,822

DATED : January 10, 1989

INVENTOR(S) : Rex B. Peters

It is certified that error appears in the above-identified patent and that said Letters Patent is hereby corrected as shown below:

| | | |
|---|---|---|
| FIGURE 4, Ref. No. 114 | | "$\Delta\delta = \ell_{c(i-1)}$" should be --$\Delta\delta_i = \ell_{c(i-1)}$-- |
| Column 2 | Line(s) 2 | "some" should be --same-- |
| 2 | 52 | after "position" delete "or velocity" |
| 11 | 11 | after "state of" insert --strain of-- |
| 12 | 43-55 | in Equation (4), "$\ldots \int_{\Sigma}^{o} \ldots$" should be --$\ldots \int_{o}^{\Sigma} \ldots$-- |
| 14 | 28 | "z-axis" should be --Z-axis-- |
| 14 | 43 | "$t_o$" should be --$t_0$-- (zero) |
| 14 | 59 | after "difference" delete "," (comma) |
| 14 | 61 | "comparsator" should be --comparator-- |
| 16 | 10 | "($\Delta(\Delta\ell_s/\Delta t$ in Fig. 3)" should be --($\Delta(\Delta\ell_s/\Delta t)$ in Fig. 3)-- |

UNITED STATES PATENT AND TRADEMARK OFFICE

CERTIFICATE OF CORRECTION

PATENT NO. : 4,797,822

DATED : January 10, 1989

INVENTOR(S) : Rex B. Peters

It is certified that error appears in the above-identified patent and that said Letters Patent is hereby corrected as shown below:

| Column | Line(s) | |
|---|---|---|
| 16 | 43 | "$\Delta(\Delta\ell)$" should be --$\Delta(\Delta\ell_s)$-- |
| 16 | 28-37 | "$\ldots \int_0^1 \ldots$" should be --$\ldots \int_0^{\ell} \ldots$-- |
| 16 | 59 | following Equation (6e), insert therefor --Where: $(\delta_{1i}-\delta_{1(i-1)})$, $(\delta_{2i}-\delta_{2(i-1)})$, $\ldots(\delta_{\theta i}-\delta_{\theta(i-1)})$ represent recursive formulations of the five integral terms in Equation 4; the subscript i denotes the current value of the associated variable (i.e., the value during the ith iteration of the signal processing sequence performed by the invention), the subscript (i-1) indicates the value of the associated variable during the previous iteration (i.e., during the ith-1 iteration) and $\Delta t$ is equal to the time interval between successive iterations.-- |
| 16 | 60 | "chsart" should be --chart-- |
| 17 | 4 | "parameters $1_{(i-1)}$;" should be --parameters $\ell_{(i-1)}$;-- |
| 17 | 4 | "$1_{(i-1)}$; and" should be --$I_{(i-1)}$; and-- |
| 17 | 22 | "variationn" should be --variation-- |

UNITED STATES PATENT AND TRADEMARK OFFICE

CERTIFICATE OF CORRECTION

PATENT NO. : 4,797,822

DATED : January 10, 1989

INVENTOR(S) : Rex B. Peters

It is certified that error appears in the above-identified patent and that said Letters Patent is hereby corrected as shown below:

| Column | Line(s) | |
|---|---|---|
| 17 | 34 | after the word "combined" delete "." (period) |
| 17 | 36 | "$[w_{ci}\ell_1 \mathrm{Cos}I_i = \mathrm{SUME}]$" should be --$[w_{ci}\ell_i \mathrm{Cos}I_i - \mathrm{SUME}]$-- |
| 19 | 12-15 | in Equation (7) "$\ldots\frac{1}{\tau}[_c(N+1/2)-\ldots$" should be --$\ldots\frac{1}{\tau}[K_c(N+1/2)-\ldots$-- |
| 19 | 60 | after "e.g." insert --,-- (comma) |
| 20 | 28 | after "of" insert --i-- |
| 20 | 41 | "Z axis" should be --Z-axis-- |
| 21 | 3 | "synchronizationn" should be --synchronization-- |
| 21 | 59 | after "$\ldots+\Delta\delta_2$" insert -- $-\Delta\delta_3$-- |
| 22 | 38 | "$[\ell_{ci} = \ell_{c(i-1)}]$" should be --$[\ell_{ci}-\ell_{c(i-1)}]$-- |
| 23 | 1 | "$\Delta\delta_{74} = [\delta_{74i}\ldots$" should be --$\Delta\delta_\theta = [\delta_{\theta i}\ldots$-- |
| 23 | 65 | "n" should be --N-- |
| 23 | 66 | after "generated" insert --,-- (comma) |

UNITED STATES PATENT AND TRADEMARK OFFICE
CERTIFICATE OF CORRECTION

PATENT NO. : 4,797,822

DATED : January 10, 1989

INVENTOR(S) : Rex B. Peters

It is certified that error appears in the above-identified patent and that said Letters Patent is hereby corrected as shown below:

| Column | Line(s) | |
|---|---|---|
| 23 | 27 | ". . .= $\Delta_{\theta pi[(i-1)]}$ (. . ." should be --. . .= $\Delta_{\theta pi}$(. . .-- |
| 25 | 28 | ". . .= $\Delta_{\theta pi[(i-1)]}$ (. . ." should be --. . .= $\Delta_{\theta pi}$(. . .-- |
| 26 | 11 | ". . . (N+1/2)- [ . . ." should be --. . . (N+1/2 [ . . . -- |
| 27 | 47 | ". . .= $\Delta_{\theta pi[(i-1)]}$ (. . ." should be --. . .=$\Delta_{\theta pi}$(. . .-- |

Signed and Sealed this

Ninth Day of July, 1991

*Attest:*

HARRY F. MANBECK, JR.

*Attesting Officer*

*Commissioner of Patents and Trademarks*